US007591402B2

(12) United States Patent
Rassias

(10) Patent No.: US 7,591,402 B2
(45) Date of Patent: Sep. 22, 2009

(54) HIGH SECURITY HOLSTER ASSEMBLY AND ENCLOSURE SYSTEM

(76) Inventor: John N. Rassias, 7678 Cedarwood Cir., Boca Raton, FL (US) 33434

( * ) Notice: Subject to any disclaimer, the term of this patent is extended or adjusted under 35 U.S.C. 154(b) by 603 days.

(21) Appl. No.: 10/503,057

(22) PCT Filed: Jan. 29, 2003

(86) PCT No.: PCT/US03/02625

§ 371 (c)(1),
(2), (4) Date: Jul. 28, 2004

(87) PCT Pub. No.: WO03/064957

PCT Pub. Date: Aug. 7, 2003

(65) Prior Publication Data

US 2005/0224537 A1 Oct. 13, 2005

(51) Int. Cl.
*F41C 33/02* (2006.01)

(52) U.S. Cl. ..... 224/243; 224/912

(58) Field of Classification Search ..... 224/192, 224/193, 196, 198, 238, 243, 587, 911, 912, 224/540, 541; 42/70.11
See application file for complete search history.

(56) References Cited

U.S. PATENT DOCUMENTS 2,893,615 A * 7/1959 Couper ..... 224/193
3,269,620 A * 8/1966 Du Bois ..... 224/222
3,744,687 A * 7/1973 Oreck ..... 294/137
4,055,015 A * 10/1977 Musgrave ..... 42/106
4,325,505 A 4/1982 Hillman
4,689,908 A * 9/1987 McClellan ..... 42/71.02
4,858,799 A 8/1989 Young
4,901,987 A * 2/1990 Greenhill et al. ..... 267/166
4,912,867 A * 4/1990 Dukes, Jr. ..... 42/70.11
5,099,596 A 3/1992 Butler, Jr.
5,215,238 A * 6/1993 Baruch ..... 224/243
5,419,069 A 5/1995 Mumbleau et al.

(Continued)

FOREIGN PATENT DOCUMENTS

DE 19952640 A1 * 6/2000

(Continued)

*Primary Examiner*—Nathan J Newhouse
*Assistant Examiner*—Justin M Larson
(74) *Attorney, Agent, or Firm*—The Webb Law Firm

(57) ABSTRACT

A holster assembly for a firearm includes a shroud (20, 92, 168) with a muzzle receiving space (31), a firearm holding member (100, 174, 246) and a bias activating assembly mounted in the shroud (20, 92, 168) for biasing the firearm into a stowed position against the holding member (100, 174, 246). A hood enclosure (166) is movable between open and closed positions. The hood enclosure (166) includes a pair of guide slots (188) within the shroud (20, 92, 168), a pivot pin (182) and a guide pin (186). The hood enclosure (166) may include an illumination device (238) mounted to the firearm, a hip mount platform (256) to mount a hip mount assembly (34), or a secondary stowage mount (270) to attach a magazine carrier (278), expandable baton carrier (266), etc. The shroud (20, 92, 168) includes a detent (178) that receives a locking safety lever (146) of the firearm. An L-shaped slot (138, 106, 162) receives a projection from a handle portion (132), a take down button (88), a safety lever (158), or another side extending projection of the firearm.

10 Claims, 30 Drawing Sheets

U.S. PATENT DOCUMENTS

| | | | | |
|---|---|---|---|---|
| 5,446,988 | A | 9/1995 | Frederick, Jr. | |
| 5,467,909 | A | 11/1995 | Resca et al. | |
| 5,611,164 | A | 3/1997 | Rassias | |
| 5,768,816 | A | 6/1998 | Rassias | |
| 5,875,944 | A * | 3/1999 | Beletsky | 224/198 |
| 6,149,042 | A | 11/2000 | Rassias | |
| 6,267,279 | B1 * | 7/2001 | Matthews | 224/243 |
| 6,415,541 | B1 * | 7/2002 | Rassias | 42/70.11 |
| 6,585,209 | B1 * | 7/2003 | Mattingly | 248/309.1 |
| 6,691,906 | B2 * | 2/2004 | Cragg | 224/238 |
| 6,732,891 | B2 * | 5/2004 | Locklear, III | 224/244 |
| 6,755,331 | B2 | 6/2004 | Rassias | |
| 2001/0048009 | A1 * | 12/2001 | Vor Keller et al. | 224/244 |
| 2003/0205594 | A1 | 11/2003 | Rassias | |

FOREIGN PATENT DOCUMENTS

| | | | |
|---|---|---|---|
| DE | 10154226 | A1 * | 5/2003 |
| WO | WO 9745691 | A1 * | 12/1997 |

* cited by examiner

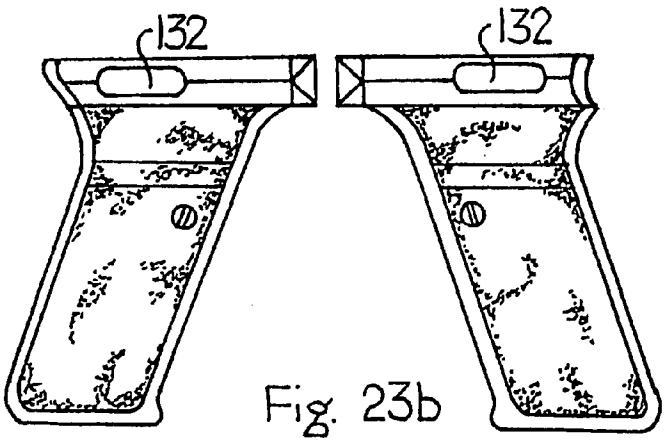
Fig. 23b
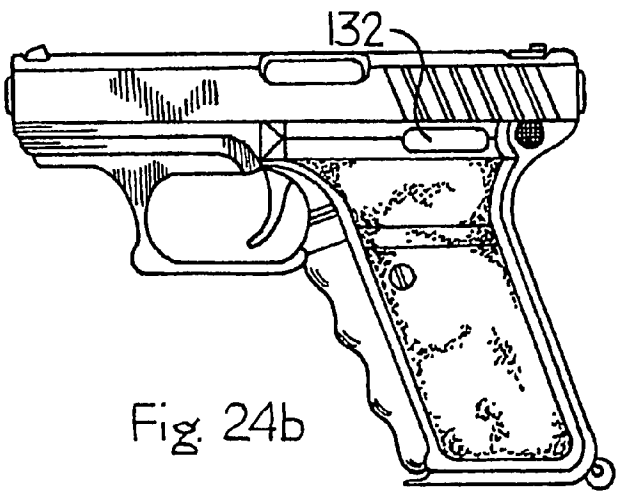
Fig. 24b
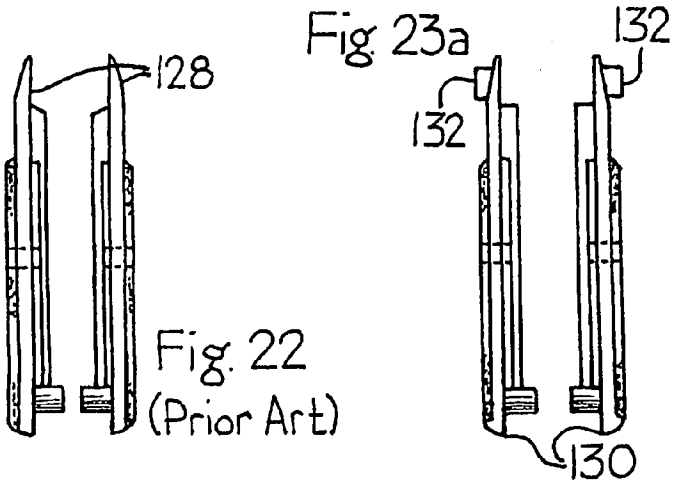
Fig. 23a
Fig. 22
(Prior Art)
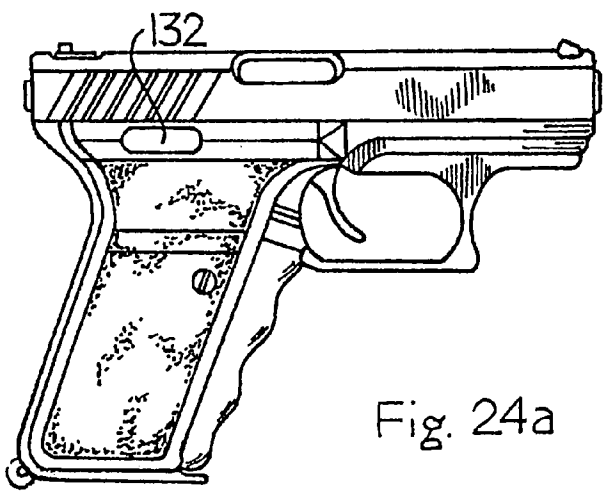
Fig. 24a

HIGH SECURITY HOLSTER ASSEMBLY AND ENCLOSURE SYSTEM

BACKGROUND OF THE INVENTION

1. Field of the Invention

This invention relates to holster assemblies and enclosures for portable firearms such as revolvers and semi-automatic pistols.

2. Description of the Prior Art

Notwithstanding massive increases in federal, state and local budgets to combat violent crimes against the general public in the United States as well as rapidly increasing physical violence against law enforcement officers, we are witnessing a worldwide presence of terrorist aggression. In most cases of threatened violence, police and other law enforcement agencies cannot respond in time to those in a dangerous confrontation to prevent injury or death. We are also witnessing the senseless self-justification of violence in the most current mental malady of the decade, road rage. Although the advent of the cell phone has afforded rapid communication to police, the violence occurs before police assistance arrives.

In response to these threats, citizens have demanded that their local and state governments pass bills allowing the public to vote on the right to carry concealed firearms. In accordance with these demands, 34 states have passed concealed carry permit laws, which in some cases, grant reciprocity for out-of-state concealed carry permits issued to residents of another state. Additionally, legislation is being sought for the issuance of a federal concealed carry permit to qualified citizens who can exhibit proficiency in safe handling and use of firearms. Recently, both houses of the United States Congress passed, with a majority of bipartisan vote, legislation signed into law by the President granting federal authorization of 80,000 commercial airline pilots to arm themselves with pistols when piloting their aircraft. Furthermore, the staff on cruise ships include armed security guards, and even gated communities are arming their staff.

Gun security and gun safety has become a necessity. A major shortcoming of a conventional holster is that a pistol inserted into the holster can be easily taken away in a gun grab attempt. Male and female officers are being killed by their own guns when they are disarmed by an increasingly violent criminal element. In response to these important realities, it is desired to provide a gun holster to keep guns secure from gun grab attempts and from unauthorized use by children and others.

In order to accommodate the different methods of carrying and storing a pistol, it is an object of the invention to provide a holster that can be adapted for these different methods of carrying and storing a pistol. In addition, it is an object to provide a holster which supercedes all government-mandated procedures for safe gun carry and storage. In some cases, government procedures require police officers to carry a pistol in Condition One, with a round chambered when carried. In others, the government requires military personnel to carry a pistol in Condition Three, with a loaded magazine but no round in chamber when carried. Civilian carry, which is reputed to be more than the combined police and military use in the United States, is projected as half in Condition One and half in Condition Three. It is an object of the invention to provide a holster system that accommodates both methods of carry while providing multiple levels of constant safety unobtainable by any other holster. The holster system should be usable with revolvers and semi-automatic pistols of the open top ejection pistols currently designed by Glock, Sig Sauer, Heckler & Koch and later versions of pistols manufactured by Walther and Beretta. Additionally, the holster should be height adjustable as well as completely ambidextrous. Illumination and laser combination modules, mounted to the trigger guard or dust cover rails of a pistol should be accommodated. The front and rear sights of the pistol should be protected from wear and misalignment when carried. Additionally, the holster system should incorporate a method of confirming the authorized possession in carrying a pistol specifically assigned to an individual that can be used in the case of onboard carry by airline pilots as well as cruise ship security.

It is an object of the invention to allow the licensed person to carry his or her weapon loaded or unloaded in a safe manner as the pistol is totally enclosed in a locked holster, access to which is controlled by the licensed person at all times.

In sum, it is an object of the present invention to provide a high security holster system that can be used with portable firearms, such as revolvers and semi-automatic pistols, that safely houses a revolver or a semi-automatic pistol.

SUMMARY OF THE INVENTION

The above objects are satisfied with the holster according to the present invention. The holster for stowing a portable handheld firearm according to the present invention includes a shroud at least partially receiving the firearm therein with the shroud defining a muzzle receiving space at one end thereof. A firearm holding member is spaced from the muzzle receiving space. A bias activating assembly is mounted in the shroud for biasing the firearm into a stowed position against the holding member.

In one embodiment of the invention a hood enclosure is provided and is moveable between an open position that allows for insertion and withdrawal of the firearm from the shroud, and a closed position which substantially encapsulates the firearm within the shroud when the firearm is in the stowed position. The hood enclosure is pivotable about an axis substantially perpendicular to an axis of the muzzle of the firearm with the firearm in the stowed position. The hood enclosure may include a locking pin that is received through aligned holes in the hood enclosure and the shroud when the hood enclosure is in the closed position for locking the hood enclosure in the closed position.

The shroud may include a spring biased detent receivable in a detent recess in the hood enclosure when the hood enclosure is in the closed position. Additionally, the hood enclosure may include a thumb actuated slide lock that is engageable with the shroud when the hood enclosure is in the closed position. The hood enclosure may include an internal identification plate that uniquely identifies the weapon as well as the user.

The hood enclosure includes a pair of guide slots wherein a guide pin of the shroud is received in the guide slots for guiding the movement the hood enclosure. The hood enclosure may include a space for receiving an illumination device, such as a small flashlight or laser of the firearm that is positioned beneath the muzzle of the firearm. The hood enclosure may further include a hip mount platform that receives fasteners for mounting a hip mount assembly for the holster, or a secondary stowage mount for extra magazine carrier or baton or the like.

In one embodiment of the invention the bias activating assembly includes a plunger assembly mounted in the shroud, the plunger assembly including a moveable plunger engaging the firearm, and a spring biasing the plunger. When the firearm is in the stowed position, the spring will bias the plunger against the firearm whereby the firearm is biased into the stowed position against the holding member. The spring may be a wave spring mounted in the muzzle receiving space of the shroud and the plunger may be a face-plate on one end of the wave spring. Further the holding member may be a rear slide receiving recess on an end of the shroud opposite the muzzle receiving space, wherein the rear slide receiving recess receives an end of the slide with the firearm in the stowed position.

In one embodiment of the invention the shroud further includes a detent that receives a locking safety lever of the firearm with the firearm in the stowed position and the locking safety lever in the safe position that prevents removal of the firearm from the holster until the locking safety lever is moved out of the safe position.

In one embodiment of the invention the bias activating assembly includes slide-engaging platform preventing forward movement of a slide of the firearm past the slide-engaging platform. A frame and barrel of the firearm will move relative to the slide during insertion and withdrawal of the firearm into and out of the shroud, whereby a recoil spring of the firearm biases the barrel of the firearm against the holding member when the firearm is in the stowed position. The holding member may include an action locking lug mounted to the shroud and received through an ejection port, such as a side or top ejection port, of the firearm with the firearm in the stowed position.

In one embodiment of the invention the shroud further includes an L-shaped slot on at least one side-thereof, wherein the L-shaped slot receives a projection extending from the side of the firearm. Each L-shaped slot may receive a projection from a handle portion of the firearm, or a take down button of the firearm, or a safety lever of the firearm, or another side extending projection.

BRIEF DESCRIPTION OF THE DRAWINGS

FIG. 22 shows a front elevational view of a standard smooth face pistol grip;

FIG. 23*a* shows a side elevational view of a right-side and left-side of a pistol grip with side locking elements made in accordance with the present invention;

FIG. 23*b* shows a front elevational view of the pistol grips shown in FIG. 23*a;*

FIG. 24*a* shows a side elevational view of the pistol grip of FIG. 23*a* mounted on a small side ejection port pistol;

FIG. 24*b* is an opposite side elevational view of the pistol shown in FIG. 24*a;*

DETAILED DESCRIPTION OF THE PREFERRED EMBODIMENTS

The present invention provides a holster assembly for portable firearms such as revolvers and semi-automatic pistols with various types of ejection ports. Specifically, the holster assembly includes a spring-loaded assembly to safely house a revolver in either a loaded or unloaded state. Alternatively, the holster assembly includes an action-locking lug to house safely a semi-automatic pistol with any type of ejection port in an unloaded status. When withdrawn from the holster, the semi-automatic pistol can be automatically loaded and cocked by the user's shooting hand. In addition, a locking mechanism is provided for all embodiments of the present invention that provides for the physical locking of a revolver and semi-automatic pistol within the holster preventing withdrawal without unlocking the lock. Finally, an enclosure is provided to be used with the embodiments to allow for storage of a firearm.

Figure 1:
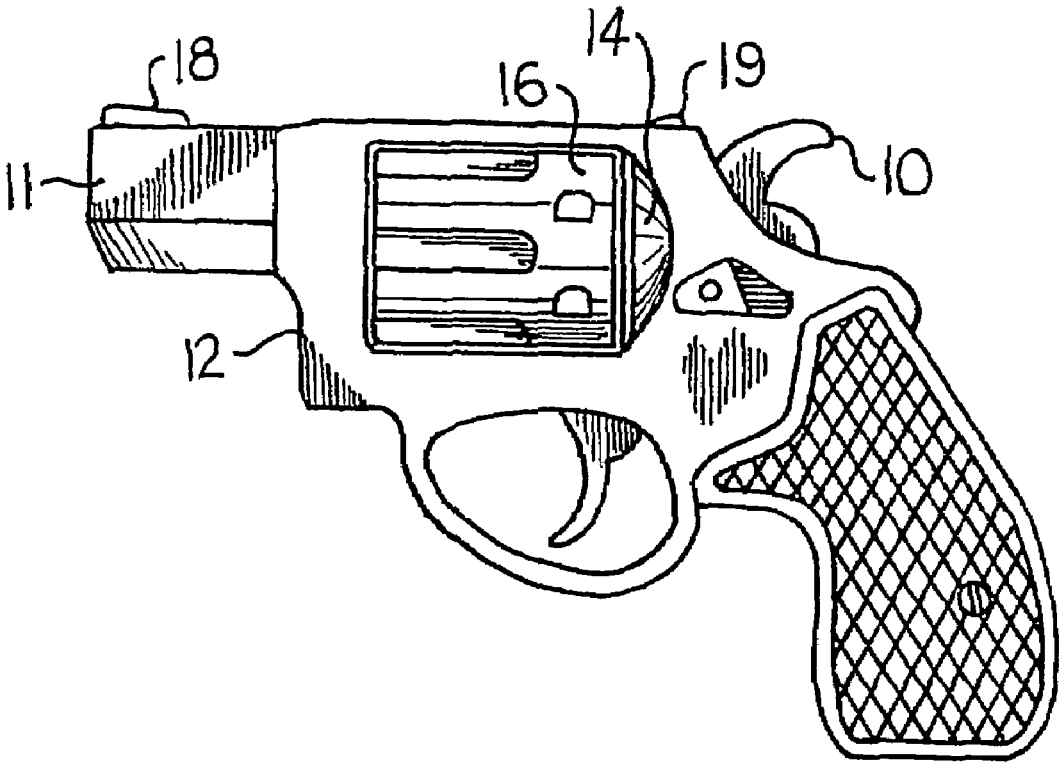
Fig. 1 (Prior Art)
FIG. 1*a* shows a side elevational view of a typical revolver.
FIG. 1*b* shows a top elevational view of the revolver shown in FIG. 1*a;*

In a first preferred embodiment as shown in FIGS. 2-7, the holster assembly is adapted to accommodate a typical revolver having a hammer 10, frame guard 12, cylinder guard 14, a cylinder 16 and front sight 18 as shown in FIG. 1. The holster assembly for revolvers is comprised of a revolver holster shroud 20 having incorporated therein a front sight protective indent 22, a hex bolt end 24, a hex bolt 26, a spring compression chamber 28, a non-marring compression plunger assembly 30, a shroud compression plunger guide 32, a frame guard locking pin port 34, a revolver cylinder indent 36 and shroud hip plate assembly bolt holes 38. The shroud can be comprised of a hard aluminum or a high-density polymer.

Figure 3:
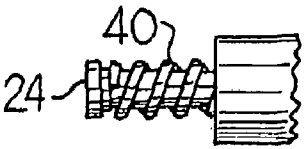
FIG. 3 shows a side elevation view of a plunger assembly of the revolver holster shroud shown in FIG. 2
Figure 4:
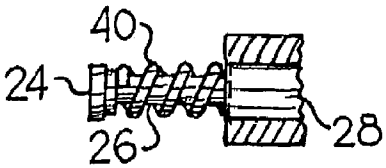
FIG. 4 is a side elevational view of a plunger assembly of the revolver holster shroud shown in FIG. 3
Figure 2:
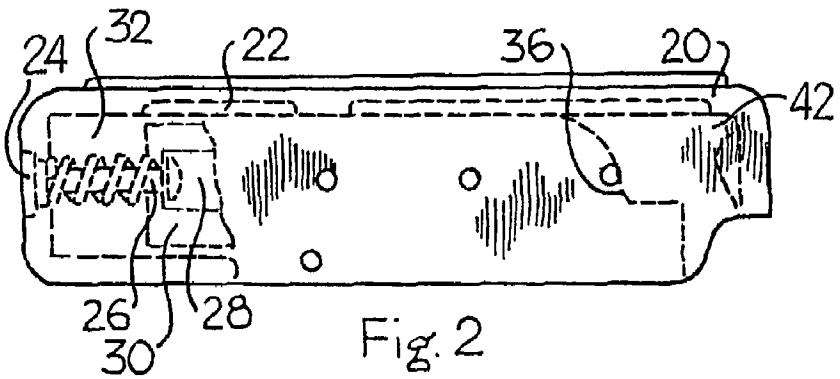
FIG. 2 shows a side elevational, view of a revolver holster shroud made in accordance with the present invention.

The revolver holster shroud 20 also includes muzzle receiving space, a high-tension plunger spring 40 and a hammer stop indent 42. The high-tension plunger spring 40 is wrapped around the threaded hex bolt 26, which is held in place at the front of the holster in a countersunk hole. The non-marring compression plunger assembly 30 shown in FIG. 3 and FIG. 4, is moveable within the limits of the shroud compression plunger guide 32 shown in FIG. 2. The non-marring compression plunger assembly 30 bears on the high-tension plunger spring 40 shown in FIGS. 2 and 3. The front sight protective indent 22 provides a space to receive the front sight 18 of the revolver when the muzzle end of the revolver is pushed against the non-marring compression plunger assembly 30.

Figure 6:
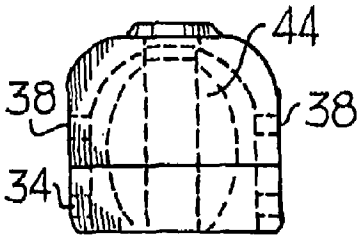
FIG. 6 is a rear elevational view of the revolver holster shroud shown in FIG. 2.
Figure 7:
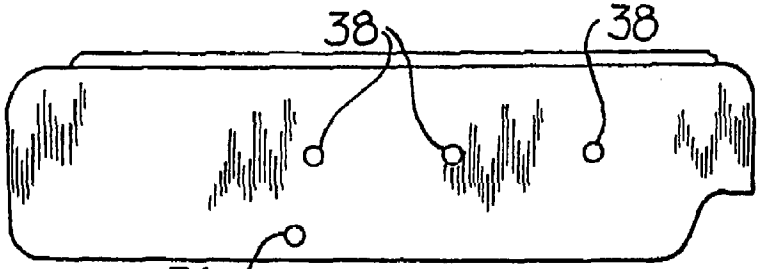
FIG. 7 is a side elevational view of the revolver holster shroud shown in FIG. 2.
Figure 5:
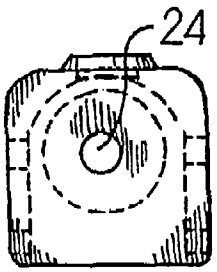
FIG. 5 is a front elevational view of the revolver holster shroud shown in FIG. 2.

When a revolver is stowed in the revolver holster shroud, the hammer stop indent 42 located on the back of the revolver holster shroud 20 provides a space to receive the hammer 10 of the revolver as shown in FIG. 6. A revolver cylinder guard indent 36 of the revolver holster shroud 20 provides an interior surface for the revolver cylinder guard 14 to rest against when the revolver is secured in the revolver holster shroud 20 by the high tension plunger spring 40.

Figure 8B:
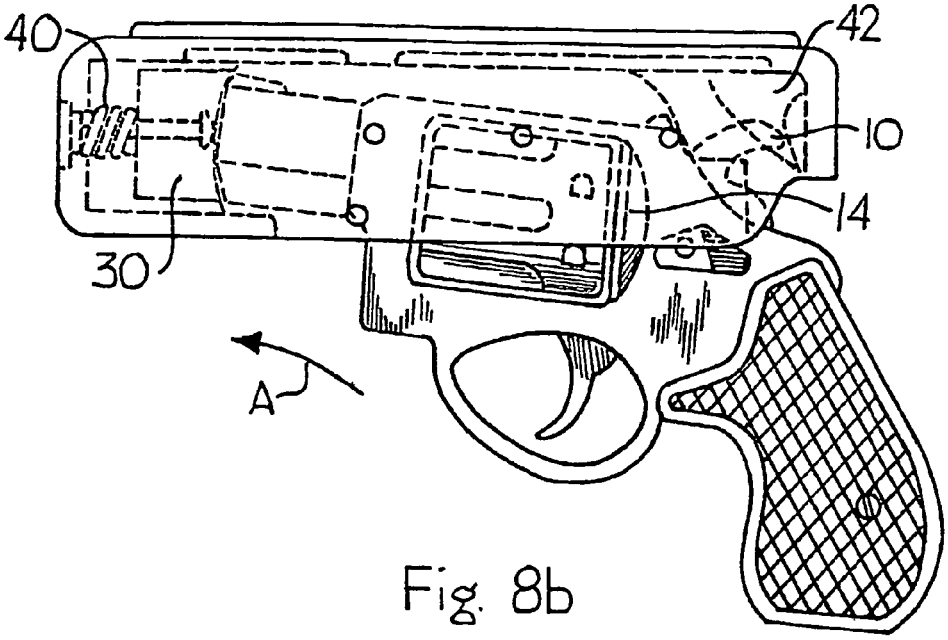
FIG. 8*b* shows a revolver further inserted into the revolver holster shroud shown in FIG. 2.
Figure 8A:
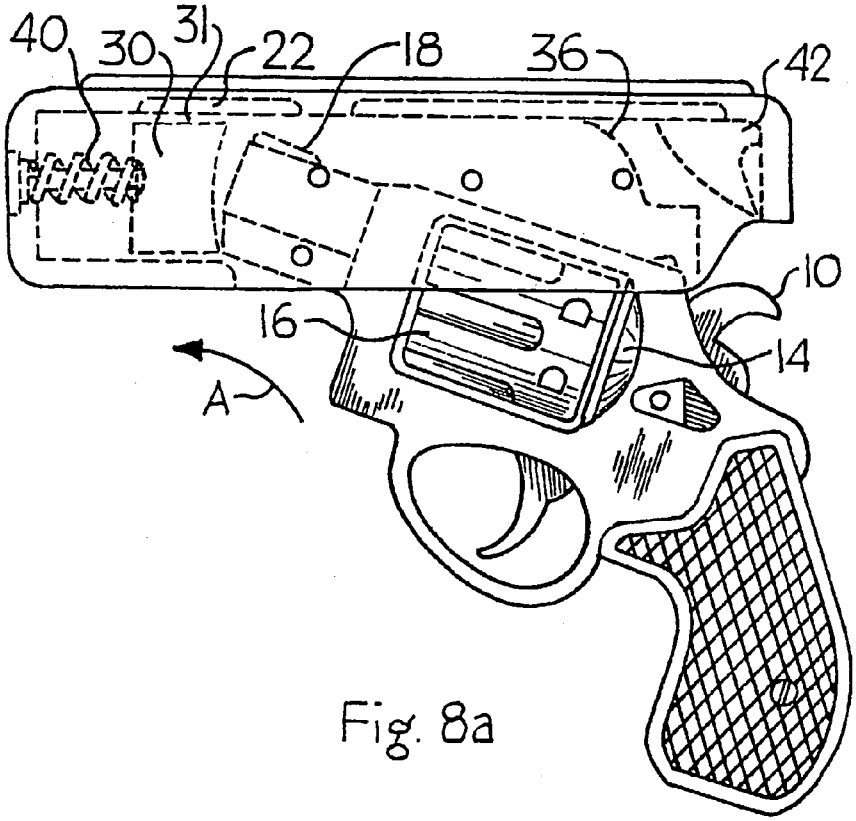
FIG. 8*a* shows a revolver being inserted into the revolver holster shroud shown in FIG. 2.
Figure 8D:
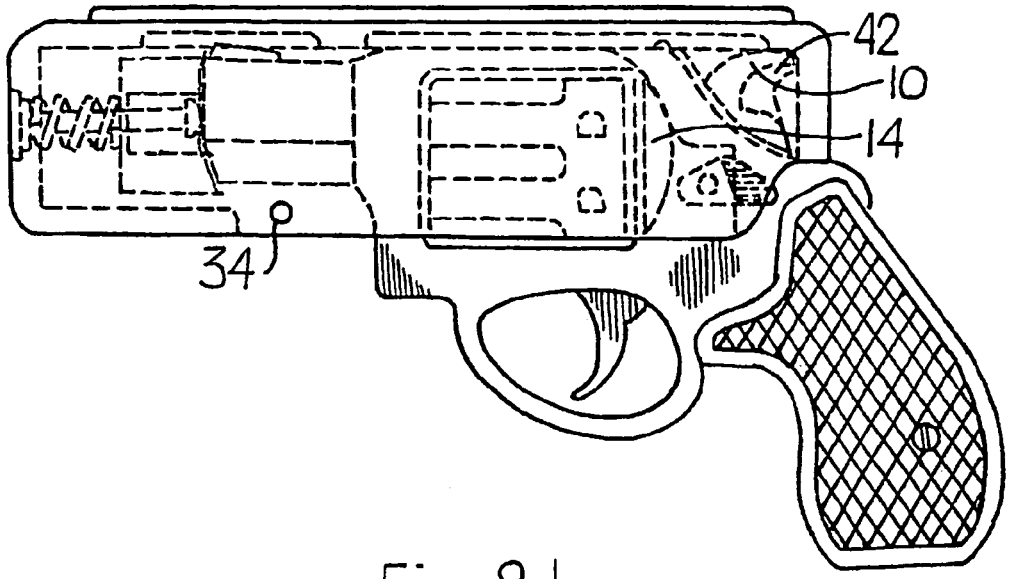
FIG. 8*d* shows a revolver fully inserted into, the shroud with the spring partially expanded pushing the trigger into rear portion of the shroud.
Figure 8C:
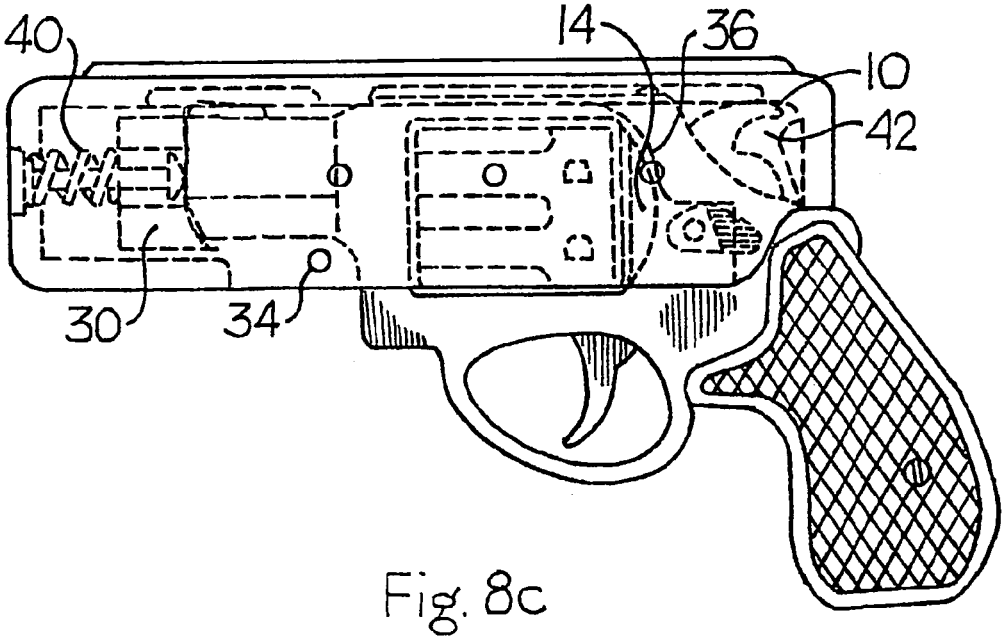
FIG. 8*c* shows a revolver fully inserted into the revolver holster shroud shown in FIG. 2 with a compression spring pressed forward into the shroud.
Figure 9:
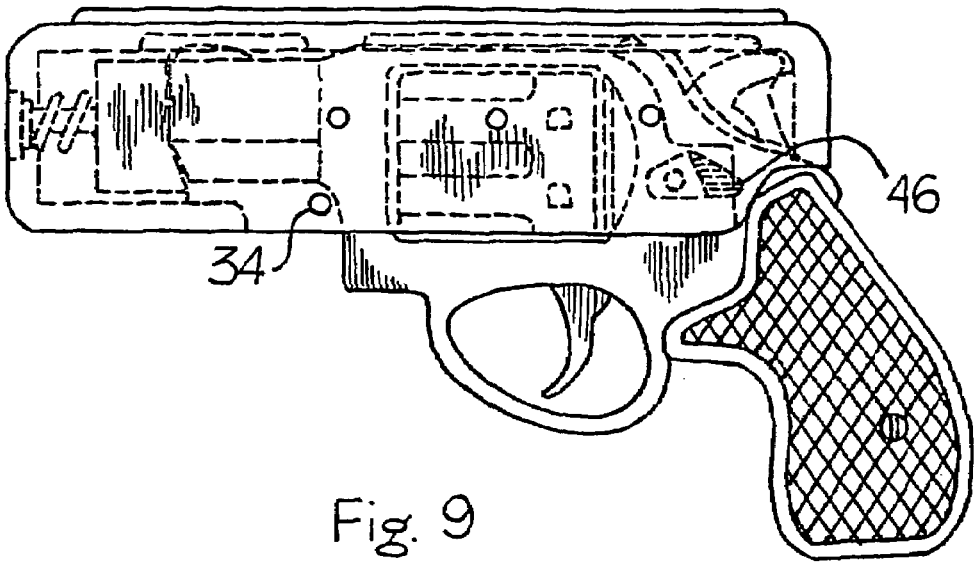
FIG. 9 shows the revolver held firmly in revolver holster shroud shown in FIG. 2 with a compression spring partially expanded.

The insertion of a revolver into the revolver holster shroud 20 is shown in FIGS. 8*a-d*. Initially, the muzzle end 11 of the revolver is placed against the non-marring compression plunger assembly 30. With a forward and downward force exerted by the revolver operator on the pistol grip, the front sight 18 enters the front sight protective indent 22 and the cylinder guard 14 enters the revolver cylinder indent 36. The muzzle end 11 of the revolver presses on the non-marring compression plunger assembly 30. A continued downward force indicated by the arrow A in FIGS. 8*a* and *b* on the non-marring compression plunger assembly 30 compresses the high tension plunger spring 40 to allow the revolver to enter further into the muzzle receiving space 31 of the revolver holster shroud 20. When the high tension plunger spring 40 is fully depressed, the revolver will be in line within the revolver holster shroud 20 pushed as far down into the revolver holster shroud 20 as possible as shown in FIG. 8*b*. Additionally, the hammer 10 of the revolver is in line with the hammer stop indent 42, and the cylinder guard 14 is in line with the revolver cylinder indent 36. When the downward force on the grip of the revolver is relaxed, the high tension plunger spring 40 will expand, pushing the non-marring compression plunger assembly 30 upward causing the cylinder guard 14 of the revolver to bear against the revolver cylinder guard indent 36 as the hammer 10 enters into the hammer stop indent 42 of the shroud as shown in FIG. 9. In the above embodiment, the high-tension plunger spring acts as the bias activating assembly for housing the pistol in the holster. The revolver is held securely stowed in place in the revolver holster shroud 20 by the expanding force of the high-tension plunger spring 40. Once the revolver is secured in the shroud, the cylinder release lever 46 is shown in FIG. 9 completely covered by the revolver holster shroud 20, protecting against the unauthorized removal of any cartridges loaded in the cylinder 16 of the revolver.

The revolver is withdrawn from the revolver holster shroud by reversing the steps for inserting the pistol into the holster.

Figure 10A:
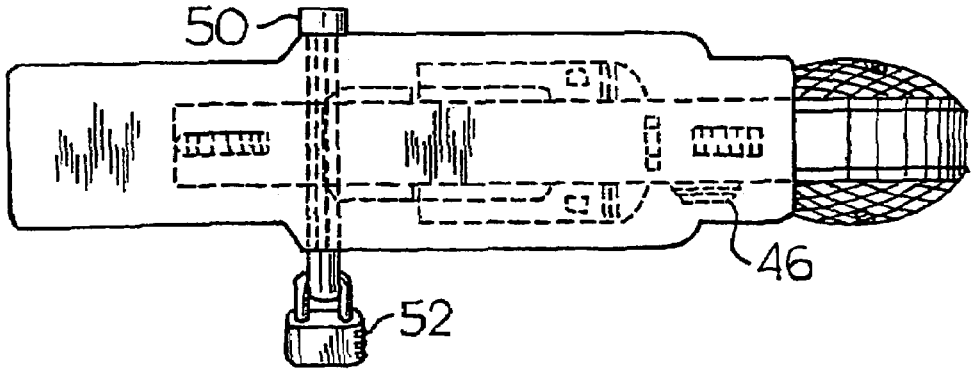
FIG. 10*a* is a top elevational view of the revolver inserted in the shroud locked into the holster with a locking pin and a combination lock.
Figure 10B:
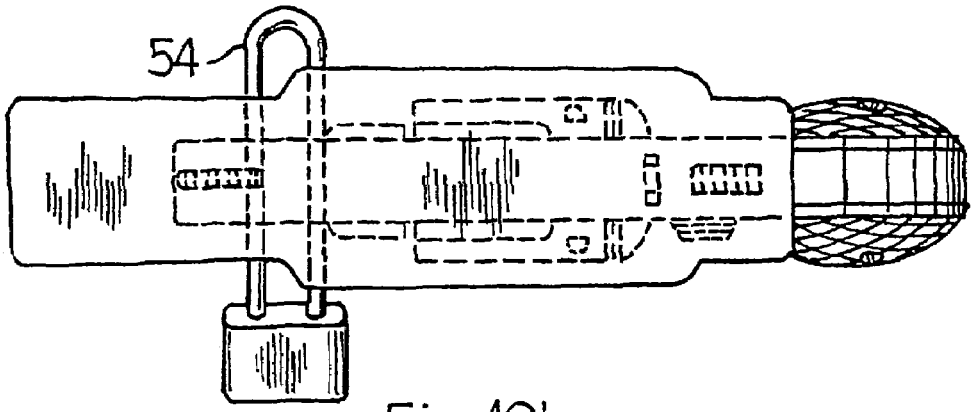
FIG. 10*b* is a top elevational view of the revolver inserted in the shroud locked into the holster with a hasp lock.

A frame guard locking pin port 34 is provided to receive a lock to prevent unauthorized withdrawal of the revolver when it is stowed in the revolver holster shroud as shown in FIG. 10*a* Preferably, the lock is comprised of a large head frame locking rod 50 made of steel, or other strong material, which can be inserted through the frame guard locking pin port 34 with the opposing drilled hole of the large head frame locking rod 50 accepting a combination lock 52 as shown in FIG. 10(*a*). Alternatively, a keyed hasp lock 54 can be used as shown in FIG. 10(*b*) to lock the pistol in the revolver holster shroud. Either lock when present in the frame guard locking pin port 34 prevents the downward compression movement required to clear the hammer 10 of the revolver from the hammer stop indent 42 and withdraw the revolver from the revolver holster shroud.

Figure 11A:
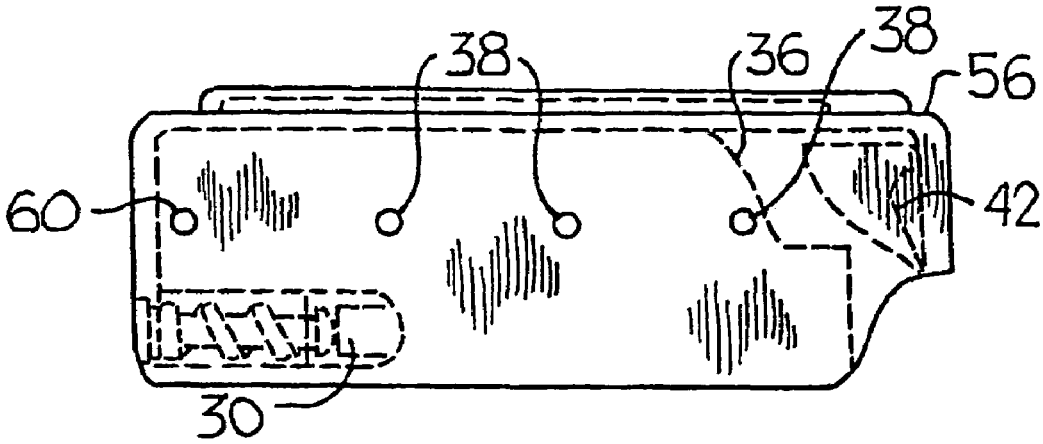
FIG. 11*a* is a side elevational view of a compact revolver holster shroud made in accordance with a second embodiment of the present invention.
Figure 11B:
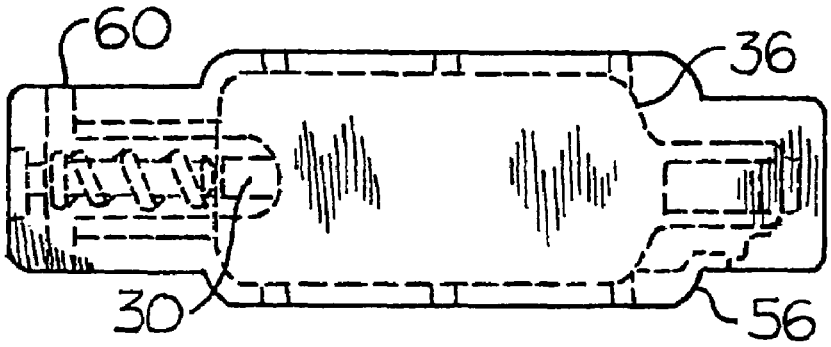
FIG. 11*b* is a top elevational view of the compact revolver holster shroud as shown in FIG. 11*a;*

In an alternative embodiment of the holster assembly for a revolver, a compact revolver holster shroud 56 is provided as shown in FIGS. 11(*a*) and (*b*). The compact revolver holster shroud 56 is a reconfigured version of the first embodiment whereby the non-marring compression plunger assembly 30 is located below the muzzle receiving space 31. The compact revolver holster shroud 56 is designed to accommodate revolver carriers that require the most compact way to conceal their handguns.

Figure 12A:
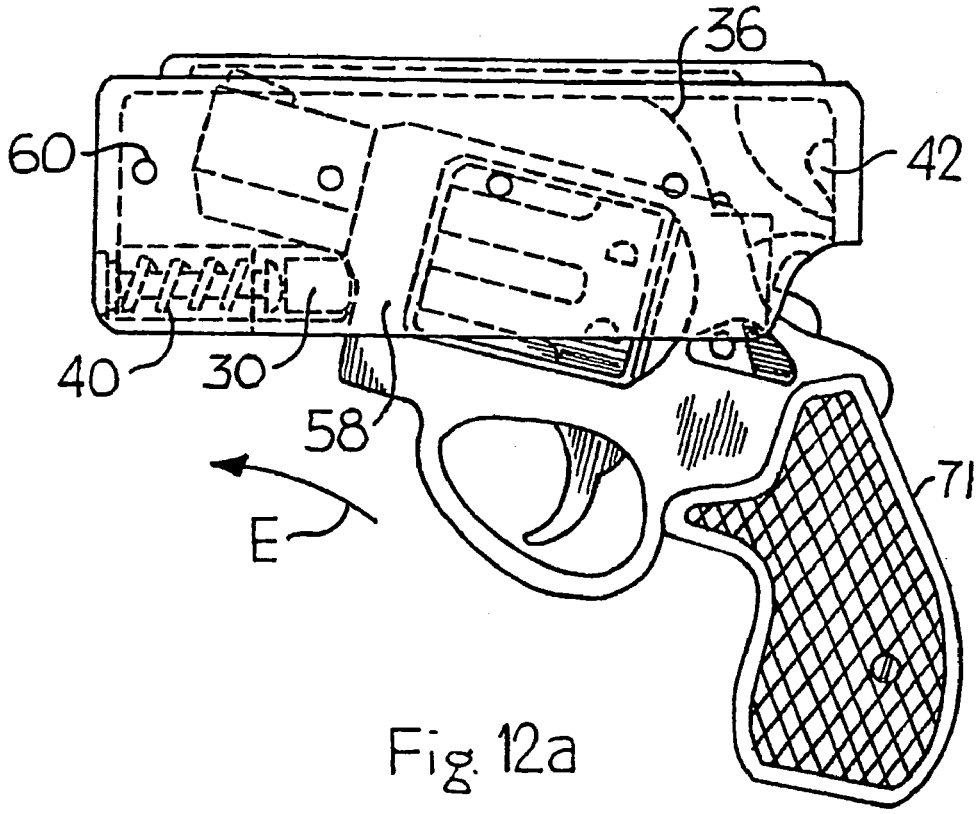
FIG. 12*a* shows a revolver being inserted into the compact revolver holster shroud shown in FIG. 11*a;*
Figure 12B:
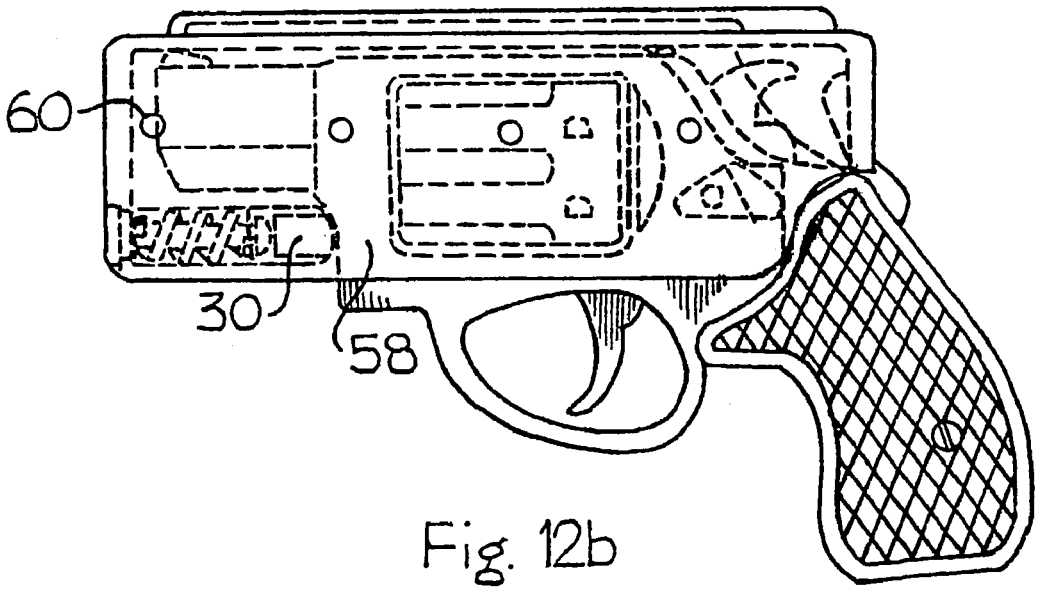
FIG. 12*b* shows a revolver fully inserted into the compact revolver holster as shown in FIG. 11*a;*
Figure 12C:
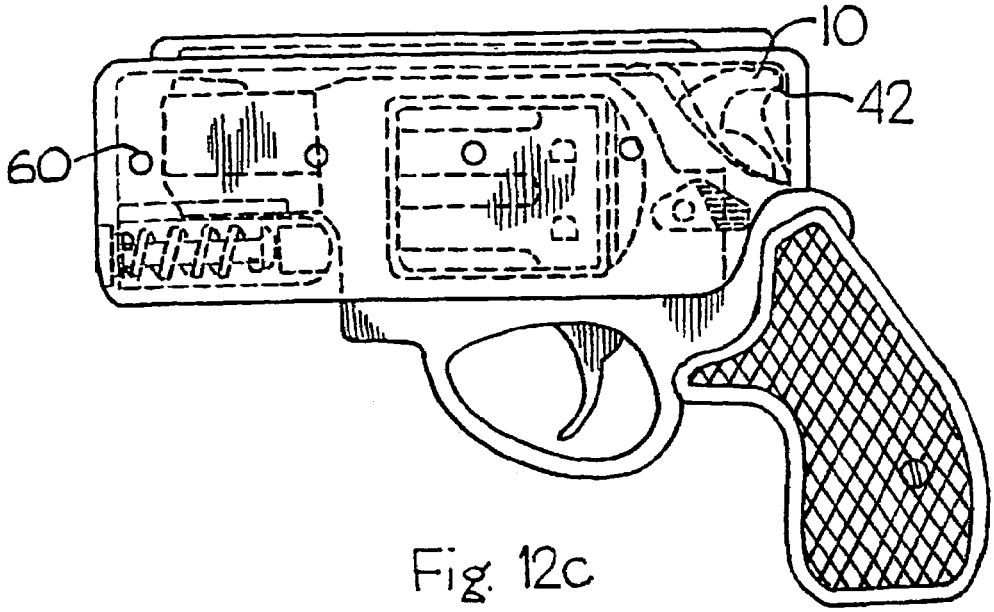
FIG. 12*c* is a side elevational view of a revolver held firmly by a partially expanded compression spring into the compact revolver holster as shown in FIG. 11*a;*

A revolver is shown in FIGS. 12*a-c* being inserted into the compact revolver holster shroud 56. The muzzle 11 of the revolver must be placed in the muzzle receiving space 31 of the revolver holster shroud 20 with a downward force on the grip of the revolver as indicated by the arrow E in FIG. 12(*a*). The non-marring compression plunger assembly 30' contacts the lower front portion of the frame 58 as shown in FIGS. 12*a-c*. A downward force exerted through the grip of the pistol forces the plunger spring to compress under pressure of the muzzle 11 of the revolver. As the non-marring compression plunger assembly 30' moves downward, the muzzle 11 of the revolver enters the muzzle receiving space 31 of the compact revolver holster shroud 56. A downward pressure on the grip 71 indicated by the arrow e in FIG. 12*a*, compresses the high-tension plunger spring 40 of the non-marring compression plunger assembly 30'. Relaxation of the downward force on the grip of the pistol causes the pistol to move back in the compact revolver holster shroud 56 placing the hammer 10 within the hammer stop indent 42. The revolver is compression locked in place as shown in FIG. 12*c*.

Figure 13A:
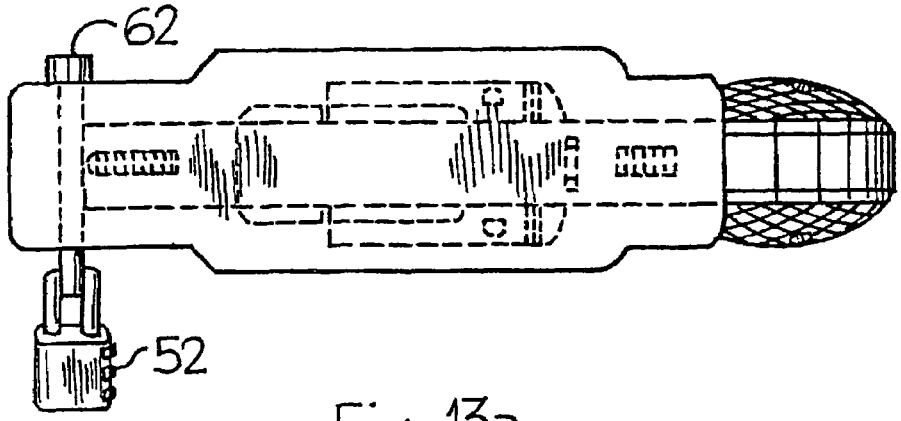
FIG. 13*a* is a top elevational view of a revolver locked into the compact revolver holster shown in FIG. 11*a* by a combination lock.
Figure 13B:
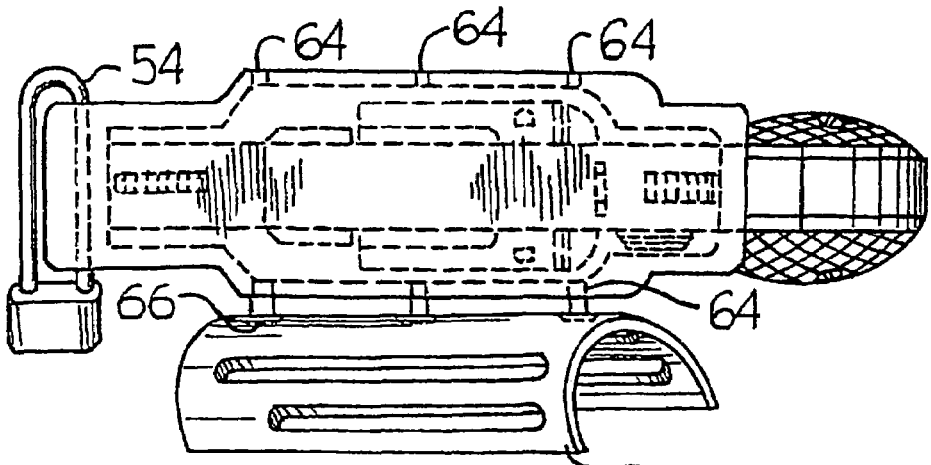
FIG. 13*b* is a top elevational view of the compact revolver holster with a hip plate assembly attached having a revolver locked into the holster by a hasp lock.
Figure 15A:
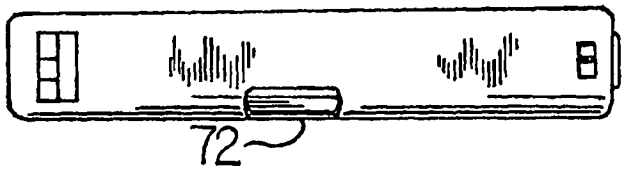
Fig. 15a (Prior Art)
FIG. 15*a* shows a top view of a side ejection port pistol.
Figure 15B:
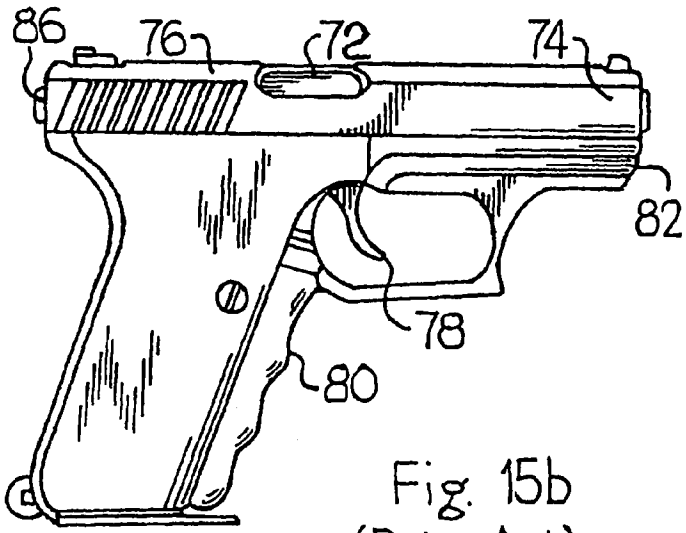
Fig. 15b (Prior Art)
FIG. 15*b* shows a side elevational view of the pistol shown in FIG. 15*a;*

A barrel locking pin port 60 is provided to receive a lock, as shown in FIG. 13*a-b*, to prevent unauthorized withdrawal of the revolver when the revolver is stowed in the compact revolver holster shroud 56. The lock may be comprised of a barrel muzzle-locking rod 62 that is placed through the barrel locking pin port 60. A hole is present at the end of barrel muzzle-locking rod 62 that accepts a combination lock 52 shown in FIG. 13*a*. Alternatively, a keyed hasp lock 54 can be inserted through the barrel locking pin port 60 as shown in FIG. 13*b*. Additionally, revolver holster shroud to hip plate mounting holes 34 are provided through which bolts 66 are to be inserted to secure the shroud hip plate assembly 68 to the revolver holster shroud as shown in FIG. 13*b*.

Figure 14A:
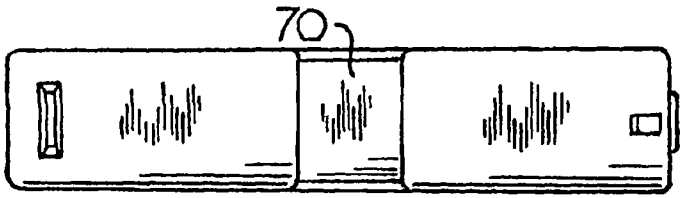
Fig. 14a (Prior Art)
FIG. 14*a* is a top view of an open top, large ejection port pistol.
Figure 14B:
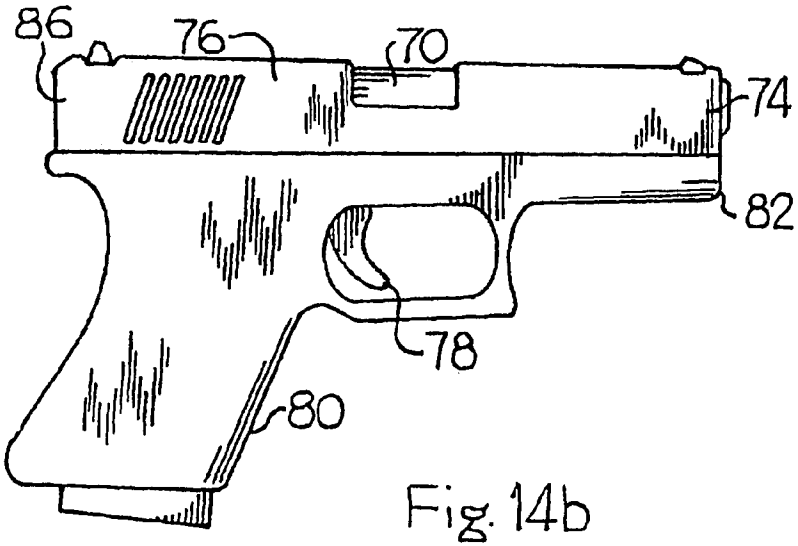
Fig. 14b (Prior Art)
FIG. 14*b* shows a side elevational view of the pistol shown in FIG. 14*a;*
Figures 16A, 16B, 16C:
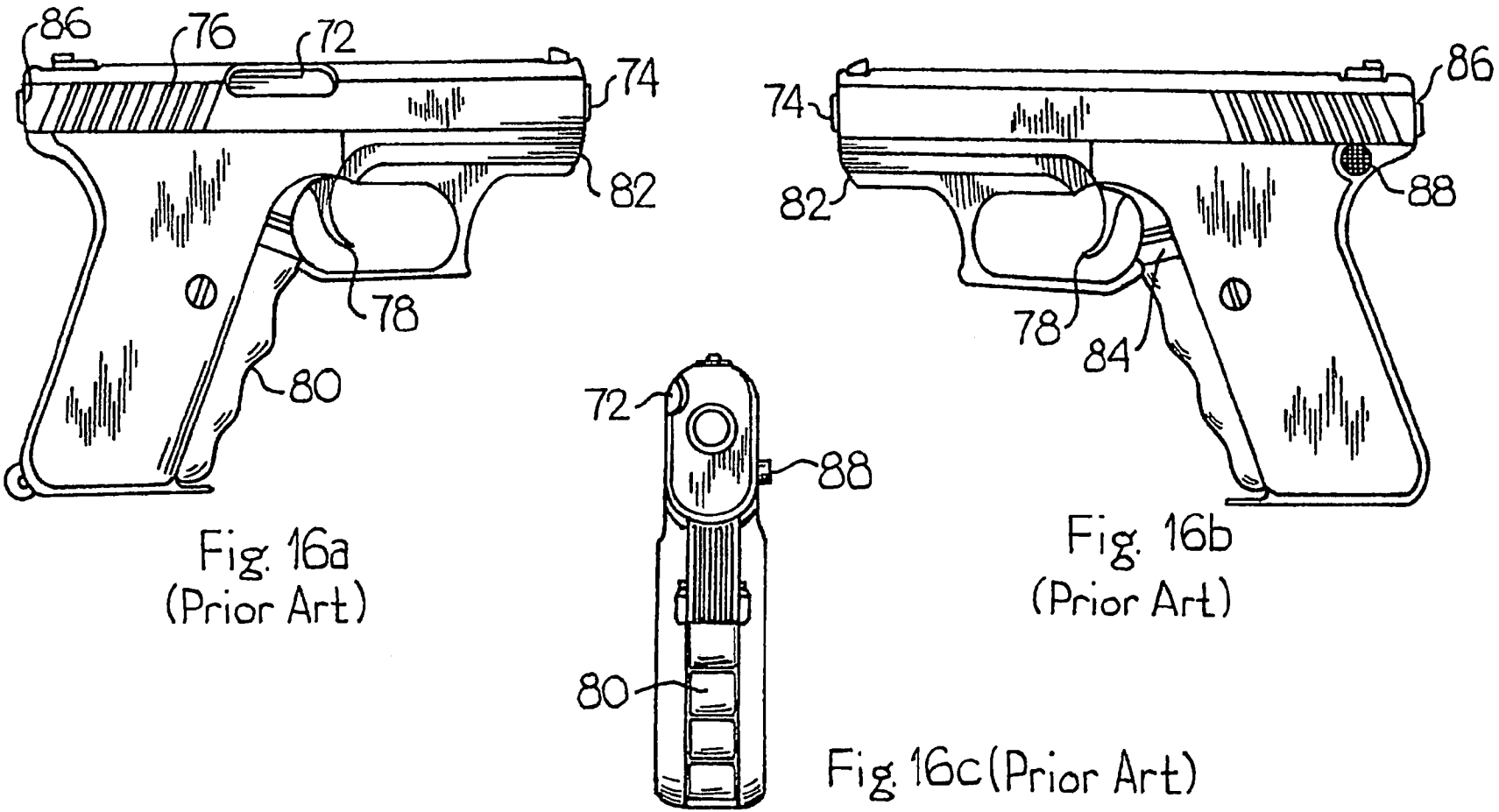
Fig. 16b (Prior Art)
Fig. 16c (Prior Art)
Fig. 16a (Prior Art)
FIG. 16*a* shows a side elevational view of a typical small side ejection port pistol.
FIG. 16*b* shows an opposite side elevational view of the pistol shown in FIG. 16*a;*
FIG. 16*c* shows a front elevational view of the pistol of FIG. 16*a;*

In a second preferred embodiment, a holster assembly is provided that safely stows a semi-automatic pistol with any type of cartridge ejection port. Pistols with an open top, large ejection port 70 similar to the pistols manufactured by Glock, Sig Sauer, Beretta and later versions of Heckler & Koch and other similar pistols are shown in FIGS. 14*a-b*. FIGS. 16*a-b* show a pistol with a narrower side ejection port 72 similar to pistols manufactured by Browning, Sig Sauer, CZ, Star, Makarov and other manufacturers. FIGS. 14*a-b*, 15*a-b* and 16*a-c* all show a pistol having a barrel muzzle end 74, a slide 76, a trigger 78, a front of a grip 80, a pistol frame 82, a rear of the slide 86, and a take down button 88 for disassembly of the pistol into its constituent parts.

Figure 17A:
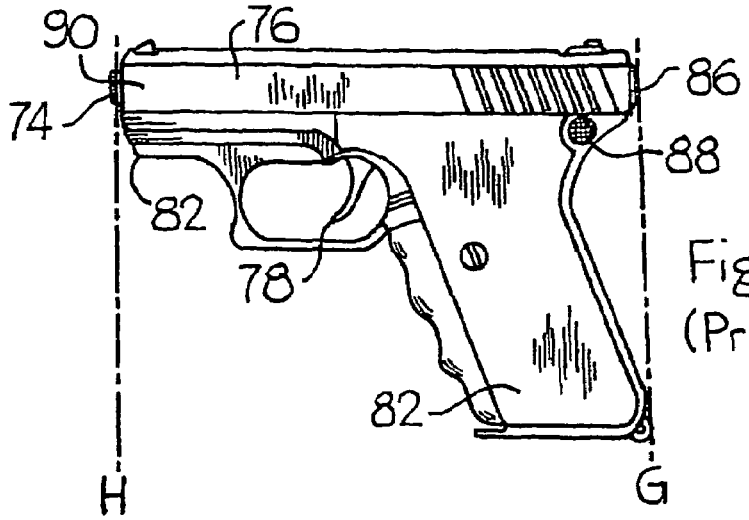
Fig. 17a (Prior Art)
FIG. 17*a* shows a side elevational view of a small side ejection port pistol with the slide fully forward.
Figure 17B:
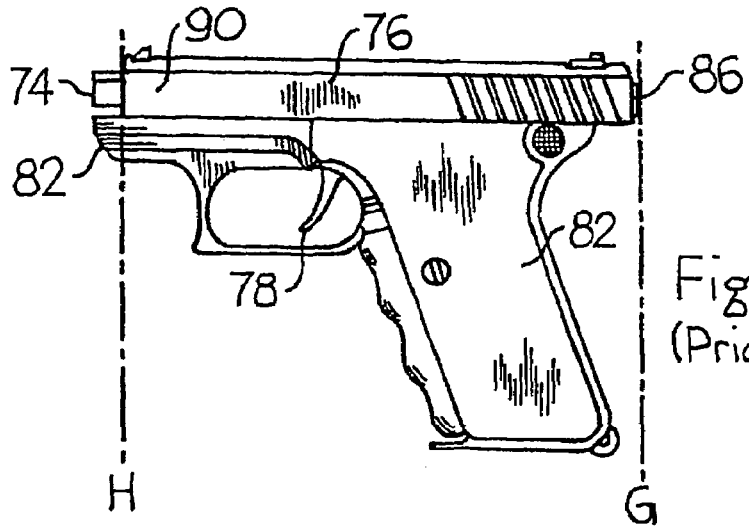
Fig. 17b (Prior Art)
FIG. 17*b* shows a side elevational view of the pistol shown in FIG. 17*a* with the slide partially to the rear.
Figure 17C:
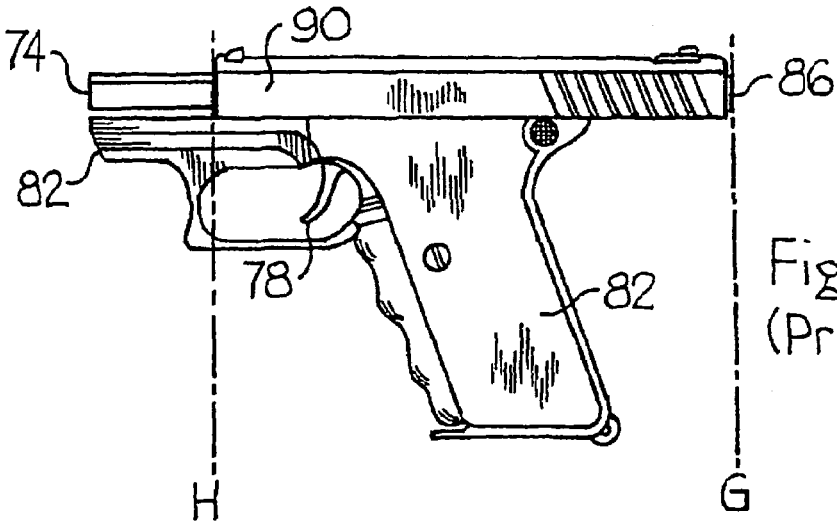
Fig. 17c (Prior Art)
FIG. 17*c* shows a side elevational view of the pistol of FIG. 17*a* with the slide fully to the rear.
Figure 18A:
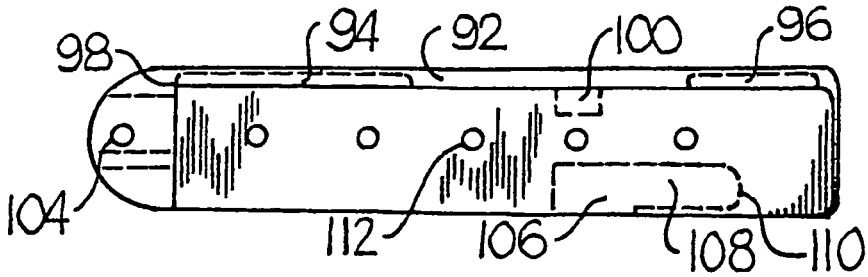
FIG. 18*a* is a side elevational view of a holster for small side ejection port type pistols made in accordance with the present invention.
Figure 18B:
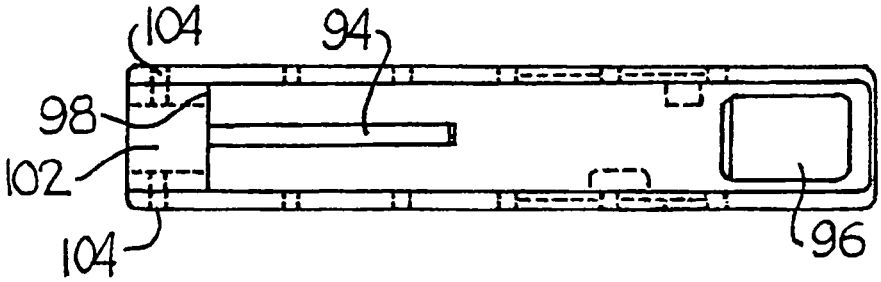
FIG. 18*b* is a bottom elevational view of the holster shown in FIG. 18*a;*
Figure 18C:
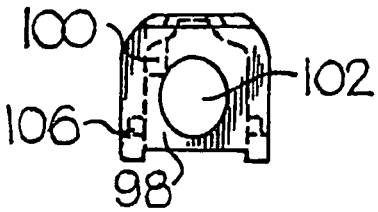
FIG. 18*c* is a front elevational view of the holster shown in FIG. 18*a;*
Figure 19:
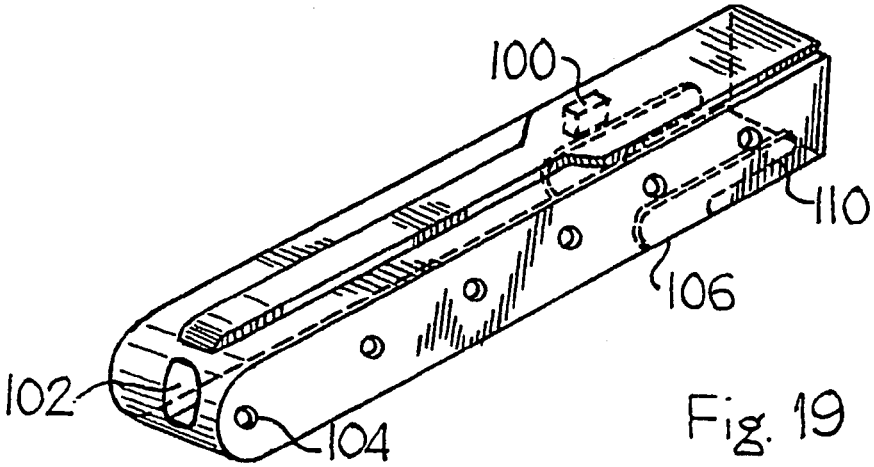
FIG. 19 is a perspective view of the holster shown in FIG. 18*a;*

A slide of a semi-automatic pistol is shown in various positions in relation to the gun frame and barrel as shown in FIGS. 17(*a-c*). The movement of the slide 76 in relation to the pistol frame 82 is indicated by two vertical arrows marked G and H as shown in FIGS. 17*a-c*. As the slide 76 of the pistol moves in relation to the pistol frame 82, the barrel muzzle end 74 and pistol frame 82 remain in the same position relative to the slide 76. The position of the slide 76 in relation to the frame 82 of the pistol is directly linked to the firing capability of the pistol.

A semi-automatic pistol is only capable of firing when the slide 76 is in the fully forward position as shown in FIG. 17*a*, indicating that the firing chamber is locked and the ejection port is closed, thereby the trigger 78 is operational. Any slight movement of the slide 76 to the rear automatically trips the trigger disconnect bar off of its seat, which controls the functioning of the trigger 78. Accordingly, when the slide 76 of a pistol moves partially to the rear of the pistol frame 82, as shown in FIG. 17*b-c,* the trigger 78 is automatically disconnected the trigger becomes inoperable. A pistol with the slide 76 fully to the rear, as shown in FIG. 17*a,* indicates that the firing chamber is completely open. As the slide returns to the forward position, the bottom of the slide 76 will strip off the top most cartridge in the magazine to load it into the battery as the slide 76 moves fully forward thereby locking the cartridge in the battery and resetting the trigger 78 in the operational firing mode. As the slide 76 moves back and forth in firing in relation to the pistol frame 82, the takedown button 88, which is fixed to the frame 82 moves with the frame 82.

In the second embodiment of the invention, a holster assembly for semi-automatic pistols with small side ejection port-type pistols is provided and is shown in FIGS. 18*a-c* and 19. The holster assembly includes a holster slide shroud 92, a front sight protective indent 94, a rear sight protective indent 96, a slide blocking face 98, a barrel receiving space 102, and an action locking lug 100. Also provided with holster slide shroud 92 are entry ports for the takedown button indents 106, a shroud takedown button channel 108, and a shroud takedown button channel stop 110. Furthermore, side shroud holes 112 are provided.

Figure 20C:
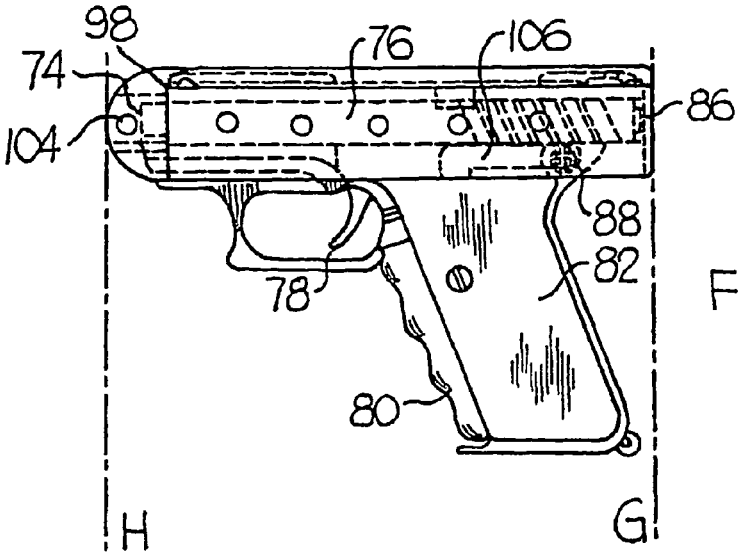
FIG. 20*c* shows the pistol shown in FIG. 20*a* fully inserted into the holster shroud.
Figure 20B:
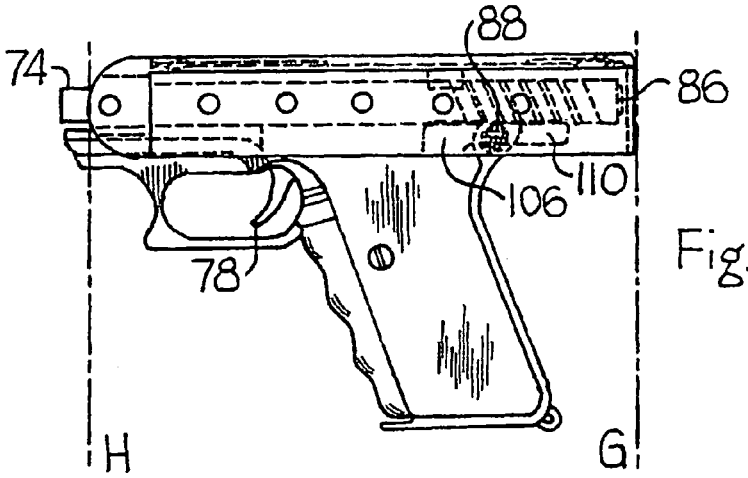
FIG. 20*b* shows the pistol shown in FIG. 20*a* partially inserted into the holster shroud.
Figure 20A:
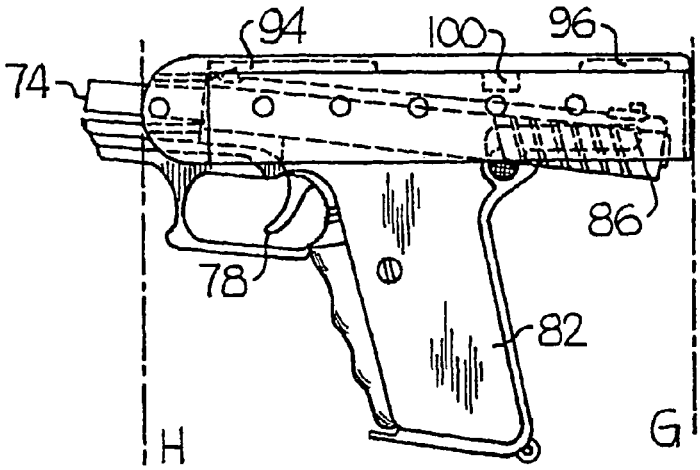
FIG. 20*a* shows a small ejection port type pistol being inserted into a holster slide shroud in accordance with the present invention.

The insertion of a semi-automatic pistol with a side ejection port type into the holster slide shroud 92 is shown in FIGS. 20(*a-c*). FIG. 20*a* show the pistol with the front of its slide 90 in contact with the slide blocking face 98, which restricts the slide 76 of the pistol from moving forward in relation to the forward movement of the pistol's frame 82 when the pistol grip 80 is pushed forward in relation to the holster slide shroud 92. The barrel muzzle end 74 protrudes slightly from the pistol's slide 76 as the pistol is placed into the holster slide shroud 92 with its chamber fully opened and the trigger 78 operational. In this position, the chamber of the pistol is cleared of any round prior to insertion of the pistol into the holster slide shroud 92. A magazine is not loaded into thee pistol in FIGS. 20*a-c.*

FIG. 20*b* shows the slide housed within the holster slide shroud 92, wherein the pistol's frame 82 is in a forward position within the holster slide shroud 92 as the pistol's slide 90 is restrained from any movement by the slide blocking face 98. The barrel muzzle end 74, when in line with the opening of the barrel port 102, will move in the same direction as the pistol's frame 82. A forward force on the grip 80 will compress the recoil spring of the pistol so that the firing chamber of the pistol opens the ejection port 2 fully, placing the now open chamber in line to accept the side molded action locking lug 100 as the pistol's grip 80 is rocked into the holster slide shroud 92. In this position, even the slightest opening of the ejection port 72 of the firing chamber, the trigger 78 of the pistol automatically becomes inoperative. When the pistol is maintained with its grip 80 fully compressed forward, the takedown button 88 for disassembly aligns with the entry port of the takedown button indent 106 as the pistol is rocked into the holster slide shroud 92. The takedown button 88 for disassembly now is in line with the shroud takedown button channel 108.

FIG. 20*c* shows the result of the release of the forward force on the pistol, whereby the pistol's frame 82 under the expanding force of the pistol's recoil spring moves the frame 82 of the pistol rearward. In the above embodiment, the recoil spring acts as the bias activating assembly for housing the pistol in the holster. As the pistol's frame 82 moves rearward, the takedown button 88 for disassembly goes rearward in the shroud takedown channel 108 until it is stopped in the shroud takedown button channel stop 110. The stopping of the rearward motion of the slide 76 of the pistol at this point allows the action-locking lug 100 to enter and bear on the ejection port 72 as the action-locking lug 100 captures the rearward motion of the slide 76. This rearward motion is in unison with the further capturing of the slide's rearward spring expansion by the takedown button 88 for disassembly at the shroud takedown button channel stop 110. The slide 76 is stowed within the holster slide shroud 92 and is kept under tension by the pistol's recoil spring. Moreover, as the pistol's frame 82 is connected by the standard barrel linking the slide 76 to the frame 82 in relation to force exerted on the standard recoil spring of the pistol, both frame 82 and slide 76 are locked into the holster slide shroud 92 until a maximum forward pressure is applied to the pistol's grip 80. Also, the rear of slide 86 is still the same distance as is the protrusion of the barrel muzzle end 74 relative to the slide 76 positioned to the frame 82. This is caused by the pressure of the action locking lug 100 bearing in the side ejection port 72 and further rearward movement of the slide 76 in relation to the frame 82 being restrained by the takedown button 88 for disassembly bearing on the shroud takedown button channel stop 110. Because the slide 76 and frame 82 are restrained from fully closing, the trigger 78 of the pistol remains inoperative.

A barrel locking pin port 104 is provided which lies directly in front of the barrel muzzle end 74. The insertion of a combination lock with a steel rod insert, or hasp padlock, as previously discussed in the first embodiment, through the barrel locking pin port 104 prevents the pistol from being removed from the holster until the lock is removed to allow the barrel to move through a barrel port 102 when pressure is applied to the pistol's grip 80. The pistol cannot be loaded nor fired because the trigger 78 is inoperable with the slide in the partially opened position.

The withdrawal of a pistol from the holster slide shroud 92 can occur by reversing the same process used to insert the pistol into the holster slide shroud 91. Prior to withdrawal of a pistol from the holster slide shroud 92, a loaded magazine may be inserted in the pistol. Thereafter, the cartridge that is present in the magazine will automatically load into the battery chamber of the pistol. Additionally, any locking devices that is present in the barrel locking pin port 104 must been removed, thereby allowing the barrel muzzle end 74 access through the barrel port 102 when forward pressure is applied to the pistol's grip 80 to overcome the expanded pressure of the standard recoil spring of the pistol.

The entry ports of the takedown button indent 106 of the holster slide shroud 92, which depends on the make and model of the pistol, gives access to a shroud takedown button channel 108, thereby allowing the takedown button 88 to be free to move within the shroud takedown button channel 108 relative to the movement of the frame 82 of the pistol when the pistol is placed within or removed from the holster slide shroud 92.

Figure 21A:
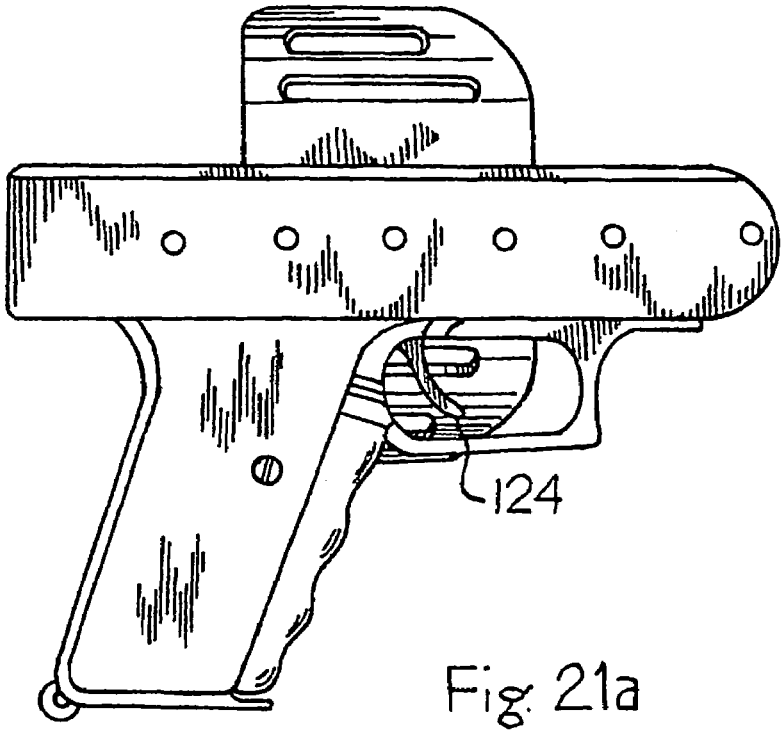
FIG. 21*a* shows a side elevational view of a holster shroud having attached thereto a shroud hip plate assembly in accordance with the present invention.
Figure 21B:
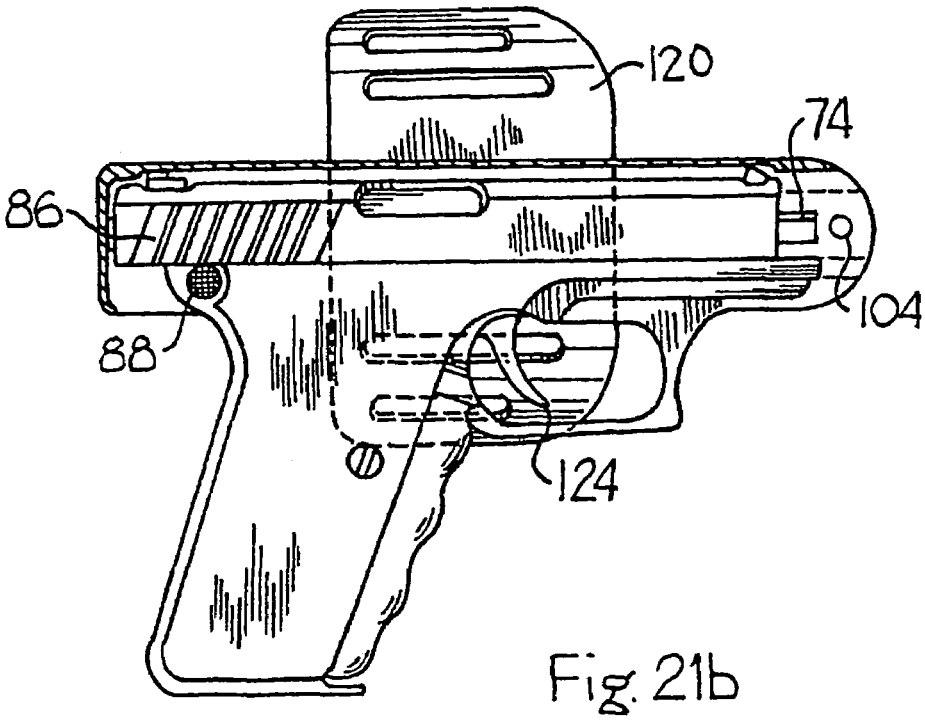
FIG. 21*b* shows a side elevational view of the holster shroud with bolts attaching the shroud to the hip plate assembly having a semi-automatic pistol locked therein.
Figure 21C:
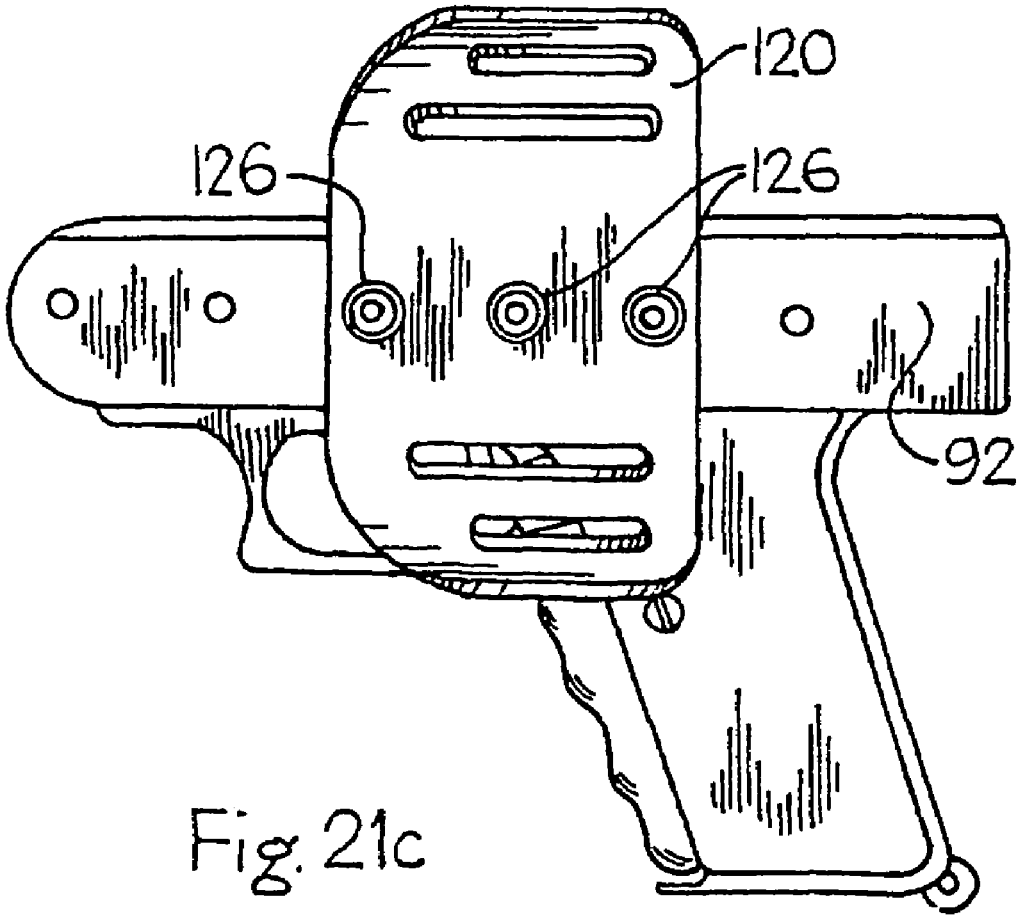
FIG. 21*c* shows a reverse view of FIG. 21*b;*

As shown in the perspective views in FIGS. 21*a-c,* shroud locking bolts 126 can be used to attach a shroud hip plate assembly 120 to the holster slide shroud 92. FIGS. 21*a-b* show a side perspective view of a pistol on a right side carry. FIG. 21*c* shows a reverse side perspective view of the pistol on a right side carry shown in FIGS. 21*a-c.*

Another embodiment of the invention includes new grips that are specifically configured to access the holster slide shroud 92 to provide the same safety benefits of the holster. Some semi-automatic pistols do not provide in line accessibility to engage the takedown button 88 for disassembly because the pistol is sold with standard'smooth face pistol grips 128 as shown in FIG. 22. These other pistols must have an alternative grip attached to allow it to be stowed safely in the holster slide shroud 92. FIGS. 23*a-b* show front and side perspective views, respectively of pistol grips 130 with slide locking lug 132 designed to function with the second embodiment of the invention. FIGS. 24*a-b* show a side elevational views of the pistol grips 130 with slide locking lug 132 incorporated into the design of the new grips.

Figure 25A:
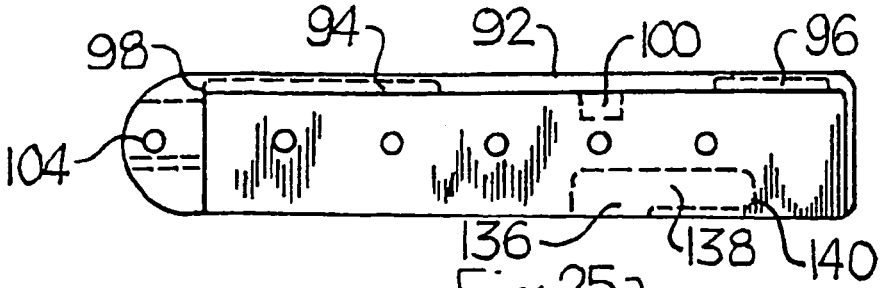
FIG. 25*a* is a side elevational view of a shroud designed to accommodate the new pistol grip made in accordance with the second embodiment of the present invention.
Figure 25B:
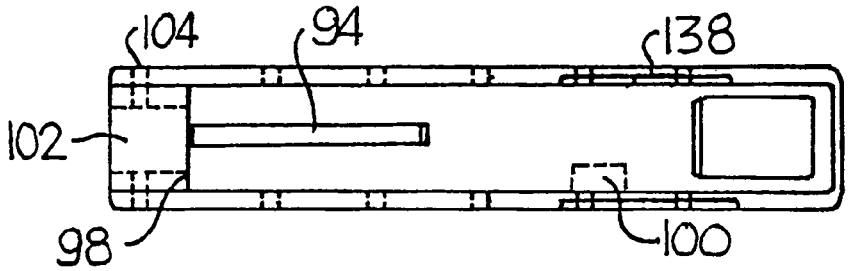
FIG. 25*b* is a top view of the shroud of FIG. 25*a;*
Figure 25C:
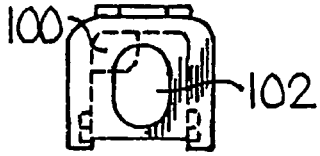
FIG. 25*c* is a front view of the shroud of FIG. 25*a;*
Figure 25D:
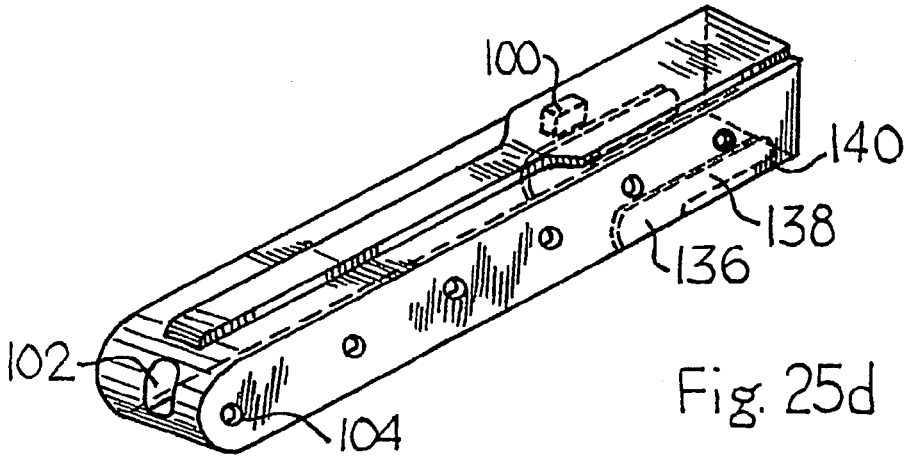
FIG. 25*d* is a front perspective view of the shroud of FIG. 25*a;*
Figure 26A:
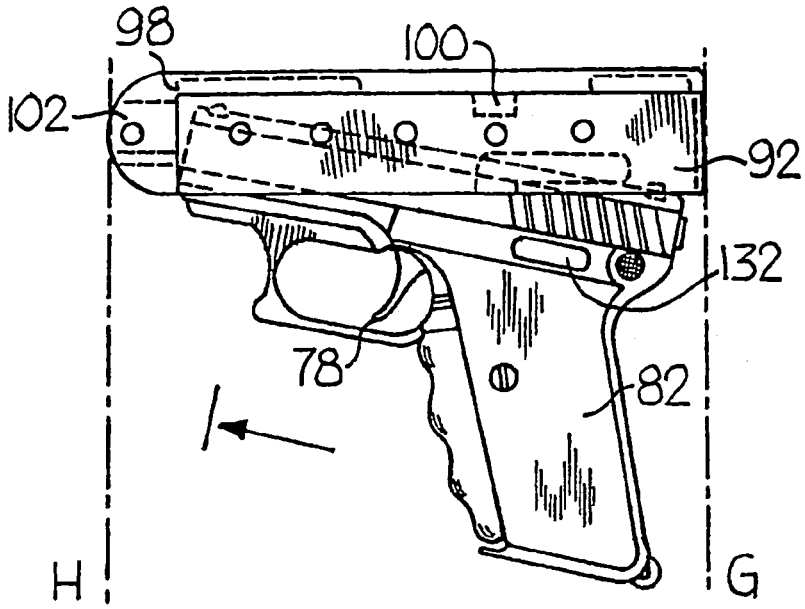
FIG. 26*a* shows a small ejection type pistol being inserted into a holster shroud in accordance with the second embodiment of the present invention.
Figure 26B:
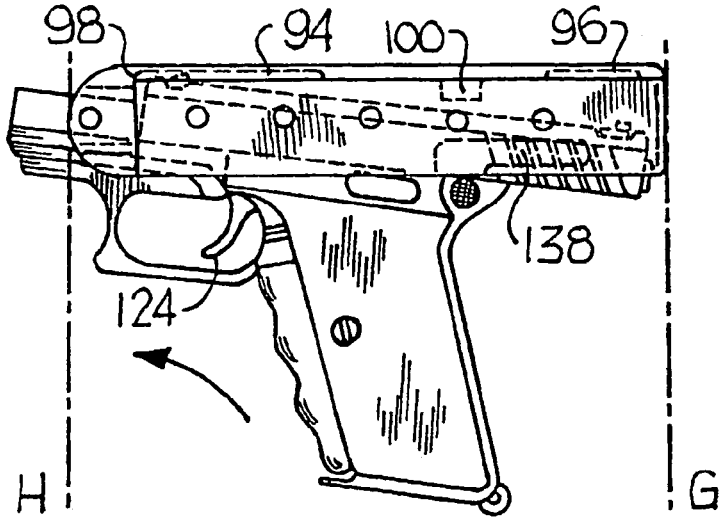
FIG. 26*b* shows the pistol partially inserted into the shroud.
Figure 26C:
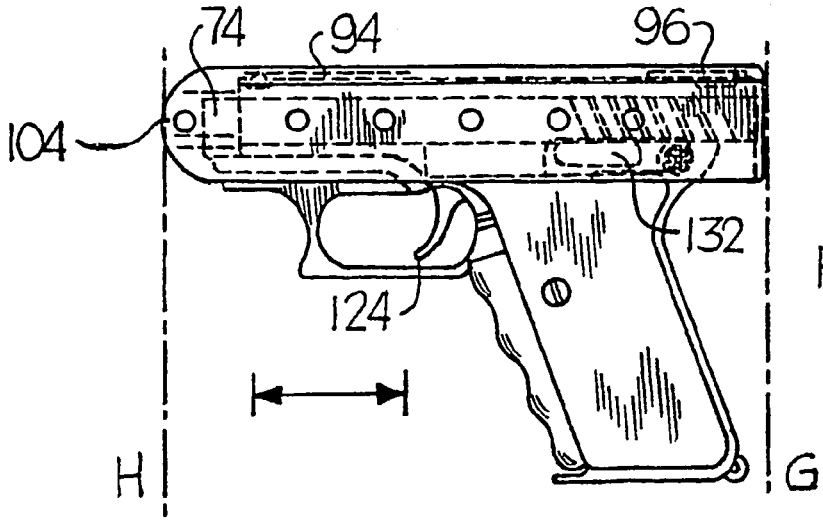
FIG. 26*c* shows the pistol fully inserted into the shroud.

As shown in FIGS. 25*a-c,* the holster slide shroud 92 includes a slide locking lug channel entry port 136, a slide locking lug channel 138 and a slide locking lug channel stop 140. During insertion of pistol with the pistol grips 130 with slide locking lug 132 as previously described and shown in FIGS. 26*a-c,* the slide locking lug 132 can enter the slide locking lug entry port 136 when the frame 82 of the pistol is moved into a forward position in relation to the slide 76. Once the slide locking lugs 132 enter the slide locking lug entry port, the forward force exerted on the grip of the pistol can be relaxed so that the slide locking lugs 132 move rearward through the slide locking lug channel as the frame of the pistol moves rearward due to the compression placed on the recoil spring. The slide locking lug channel stop 140 stops any further rearward movement of the frame 82 in relation to the pistol while not allowing the slide to lock fully forward thereby closing the chamber and activating the trigger, thereby compression locking the pistol in the holster slide shroud 92 in the stowed position as shown specifically in FIG. 26*c.*

Figure 27A:
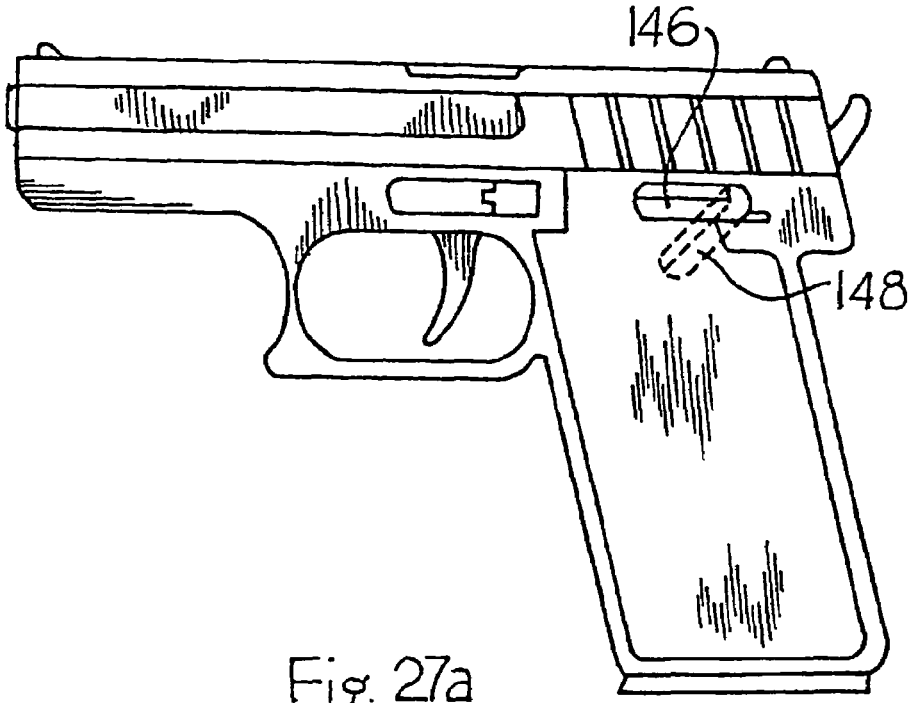
Fig. 27a (Prior Art)
FIG. 27*a* is a side elevational view of a large top ejection port pistol with the safety lever in the neutral mode.
Figure 27B:
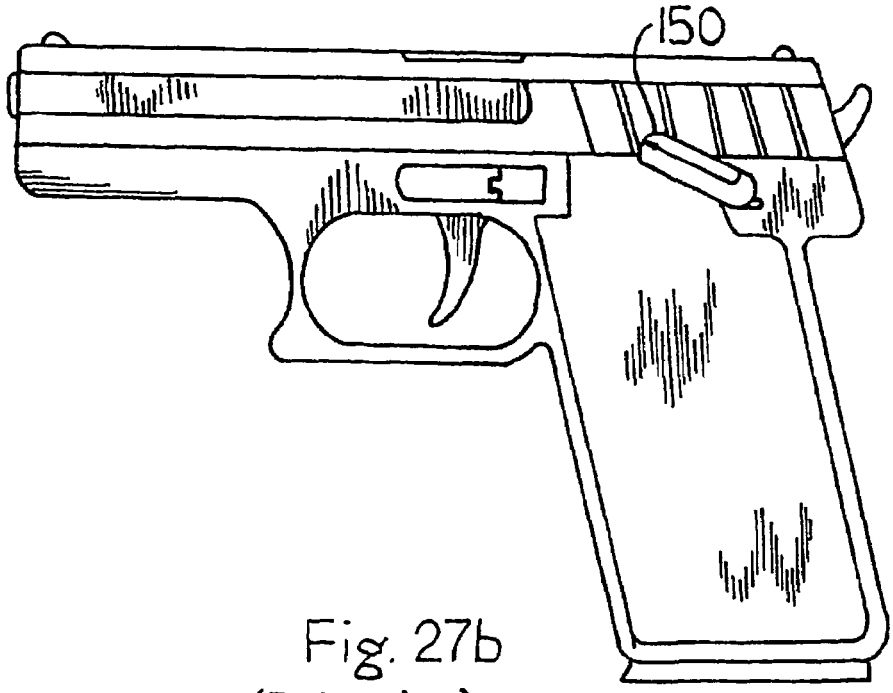
Fig. 27b (Prior Art)
FIG. 27*b* is a side elevational view of the pistol of FIG. 46 with the safety lever in the safe mode.

A semi-automatic pistol with a large top ejection port 70 is shown in FIGS. 27*a-b* with a frame mounted de-cocking and safety mechanism 146. The frame mounted de-cocking and safety mechanism 146 can be placed in a neutral standby double action mode 146 as shown in FIG. 27*a,* whereby the trigger 78 can be pulled and the hammer of a double action designed pistol will cock and release to discharge a round if a cartridge is loaded in the battery chamber. Additionally, the frame mounted de-cocking and safety mechanism 146 can be used to de-cock a pistol with a cocked hammer by rotating the mechanism 148, thereby causing the hammer to trip forward without striking the firing pin. Furthermore, the frame mounted de-cocking and safety mechanism 146 can be pushed into an up position 150, which activates a safety mechanism within the pistol to de-activate a double action trigger. When the frame mounted de-cocking and safety mechanism 146 is in the up position 150, the pistol's trigger 78 cannot be operated until frame mounted de-cocking and safety mechanism is pushed into the neutral standby double action mode 146.

Figure 28A:
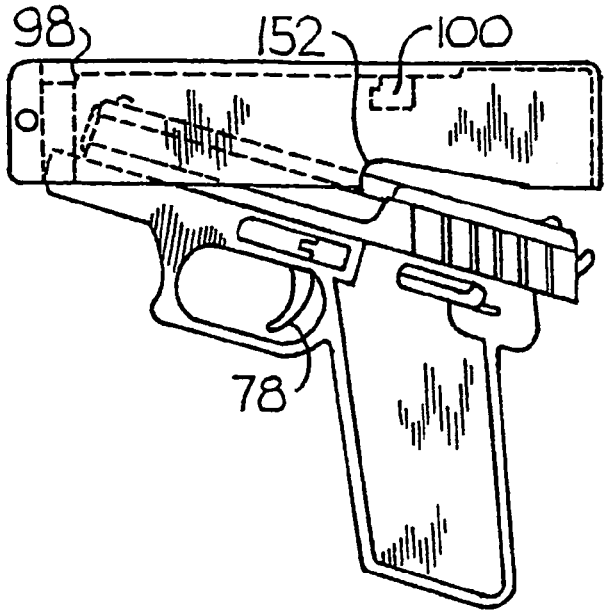
FIG. 28*a* shows a large top ejection port pistol being inserted into a holster shroud in accordance with the third embodiment of the present invention.
Figure 28B:
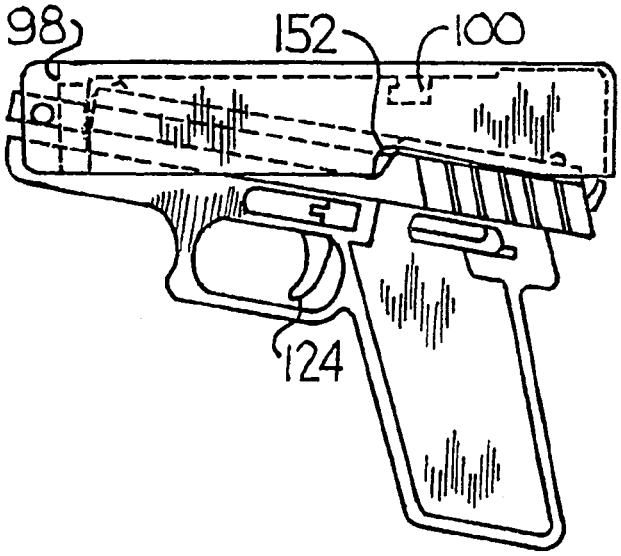
FIG. 28*b* shows the pistol partially inserted into the shroud.
Figure 28C:
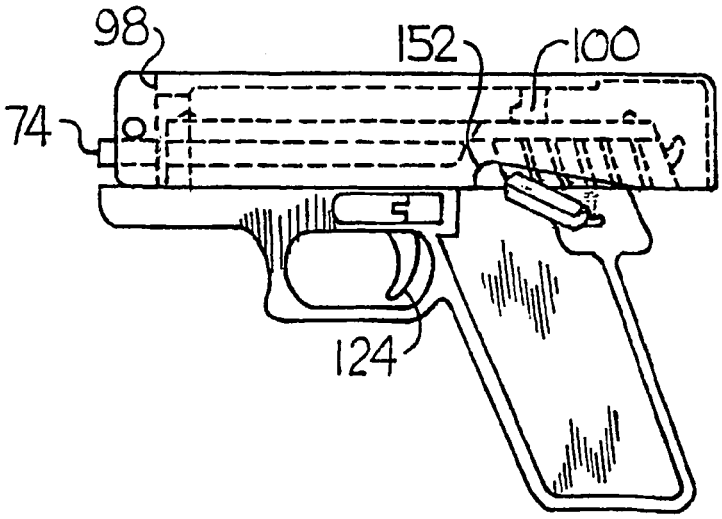
FIG. 28*c* shows the pistol firmly held in the shroud with the safety lever in the safe position.

In another embodiment of the invention, a slide shroud de-cocking and safety lever detent 152 is provided in the holster slide shroud 92. The slide shroud de-cocking and safety lever detent 152 receives a de-cocking and safety lever 148 when a pistol with a de-cocking and safety lever 148 is stowed in the holster slide shroud 92. As shown in FIGS. 28*a-b,* a large ejection port 70 pistol is being inserted into a holster slide shroud 92. The pistol is placed in the holster slide shroud having a magazine out of the pistol, an uncocked hammer 154, a trigger 78 in an operational mode and the safety de-cocking lever 148 is in neutral standby double action mode 146. As shown in FIGS. 28*a-b,* the pistol frame 82 is pushed forward and the slide blocking face 98 blocks the slide 76 from moving in the forward direction, and the barrel muzzle end 74 moves through the barrel port 102 of the holster slide shroud 92 thereby compressing the pistol's recoil spring causing the action of the pistol to fully open below the position of the action locking lug 100. In this position the pistol is empty, the trigger is disengaged 124 and the hammer is cocked 156. When the forward force exerted against the recoil spring through the grip and frame of the pistol is relaxed, the recoil spring expands, moving the frame rearward so that the side molded action locking lug 100 is fully within the firing chamber of the pistol. At this point, the pistol is now stowed in the holster slide shroud 92 and the trigger 78 is disconnected 124. In accord with the invention, the pistol frame 82 cannot go any farther to the rear as it is blocked by the side molded locking action lug 100 in the chamber. The frame mounted safety de-cocking lever 148 in neutral standby double action mode 146 is adjacent to the slide shroud de-cocking and safety lever detent 152 as shown in FIG. 28*c.* When the safety de-cocking lever 148 is placed in the up position, the safety de-cocking lever 148 is prevents the pistol from being withdrawal from the holster slide shroud 92 until the safety de-cocking lever 148 is manually pushed down out of the slide shroud de-cocking and safety lever detent 152 by the operator of the pistol. When the pistol is in this position in the holster slide shroud 92, the pistol can be withdrawn from the holster unloaded by first removing the magazine and then the pistol. Alternatively, the magazine can be left in the pistol so that when the pistol is withdrawn from the holster, the pistol is loaded, cocked and ready to fire.

Figure 29A:
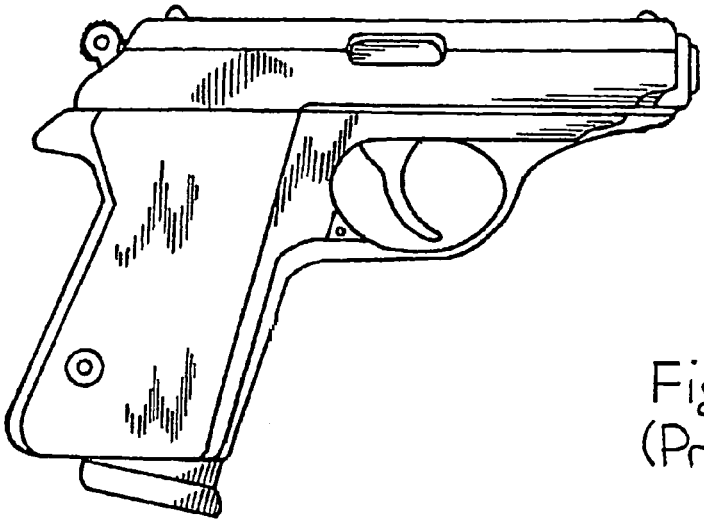
Fig. 29a (Prior Art)
FIG. 29*a* shows a right side elevational view of a semi-automatic pistol with an extremely small ejection port.
Figure 29B:
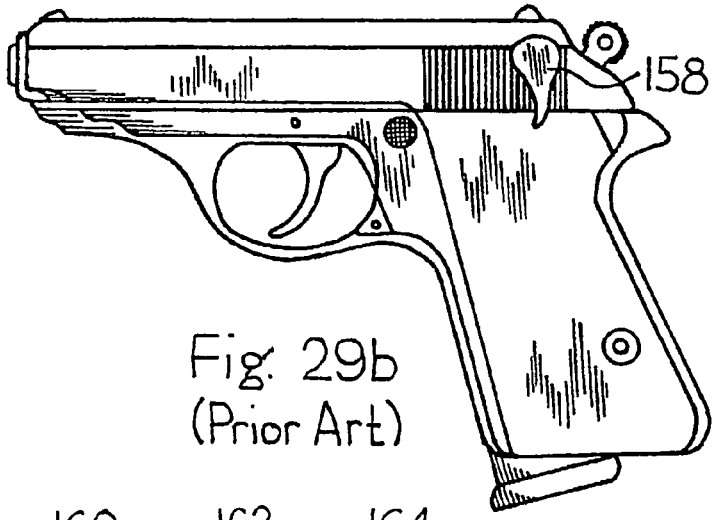
Fig. 29b (Prior Art)
FIG. 29*b* shows a left side elevational view of a semi-automatic pistol with an extremely small ejection port.
Figure 29C:
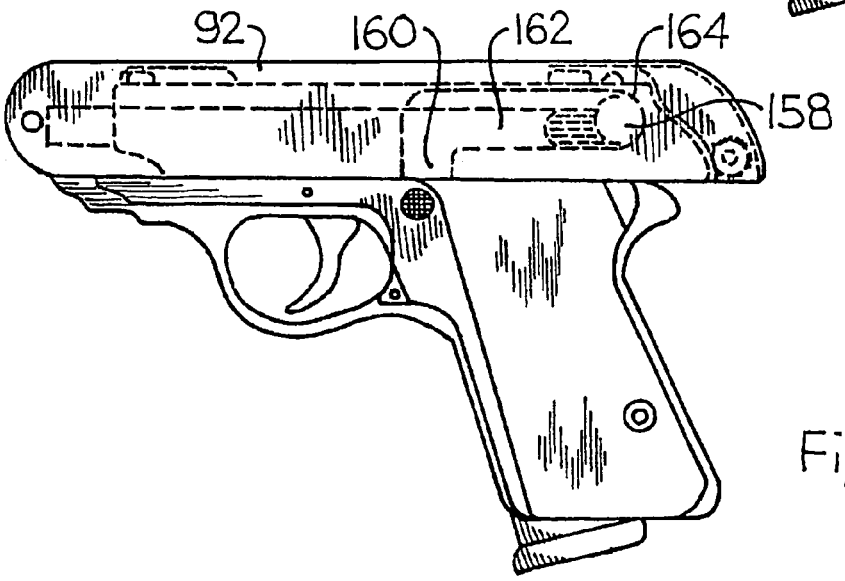
FIG. 29*c* shows a side elevational view of a semi-automatic pistol with an extremely small ejection port stowed in a holster slide shroud according to a fourth embodiment of the invention.

In further modification of this embodiment, a holster slide shroud 92 includes a slide mounted de-cocking and safety lever entry port 160, a slide-mounted de-cocking and safety lever channel 162, and a slide mounted de-cocking and safety lever channel stop 164, which provide a receiving space for the slide mounted de-cocking and safety lever 158. FIGS. 29*a-c* show a pistol with an extremely small side ejection port 2, having a differently mounted combination slide mounted de-cocking and safety lever 158. As this type of pistol is extremely small, an offset ejection port does not lend itself to accommodate a side molded action-locking lug 100 in its firing chamber.

Figure 38:
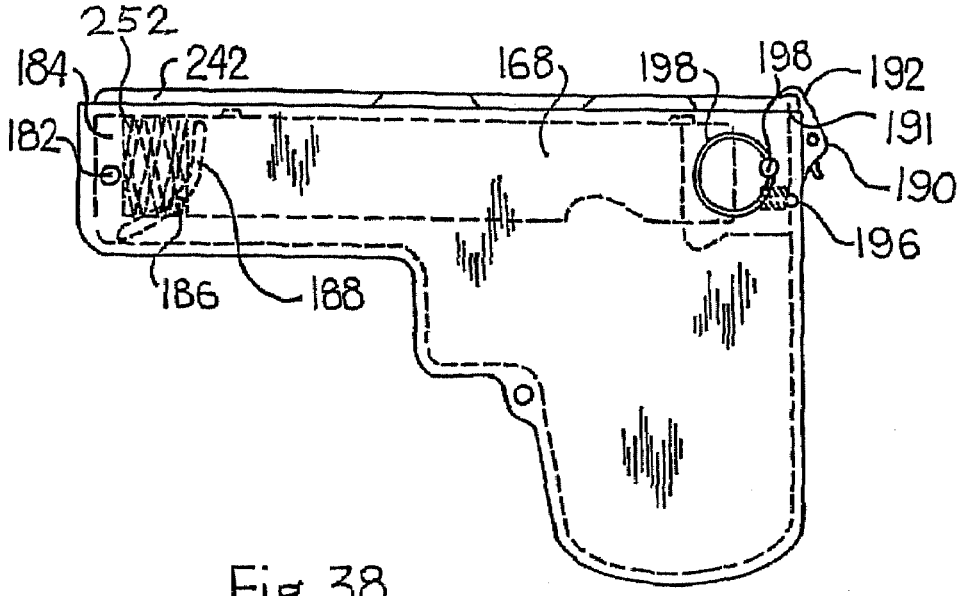
FIG. 38 shows a side elevational view of a mountable holster shroud with a wave spring and a rotatable pistol-encapsulating cover in the closed position.
Figure 39:
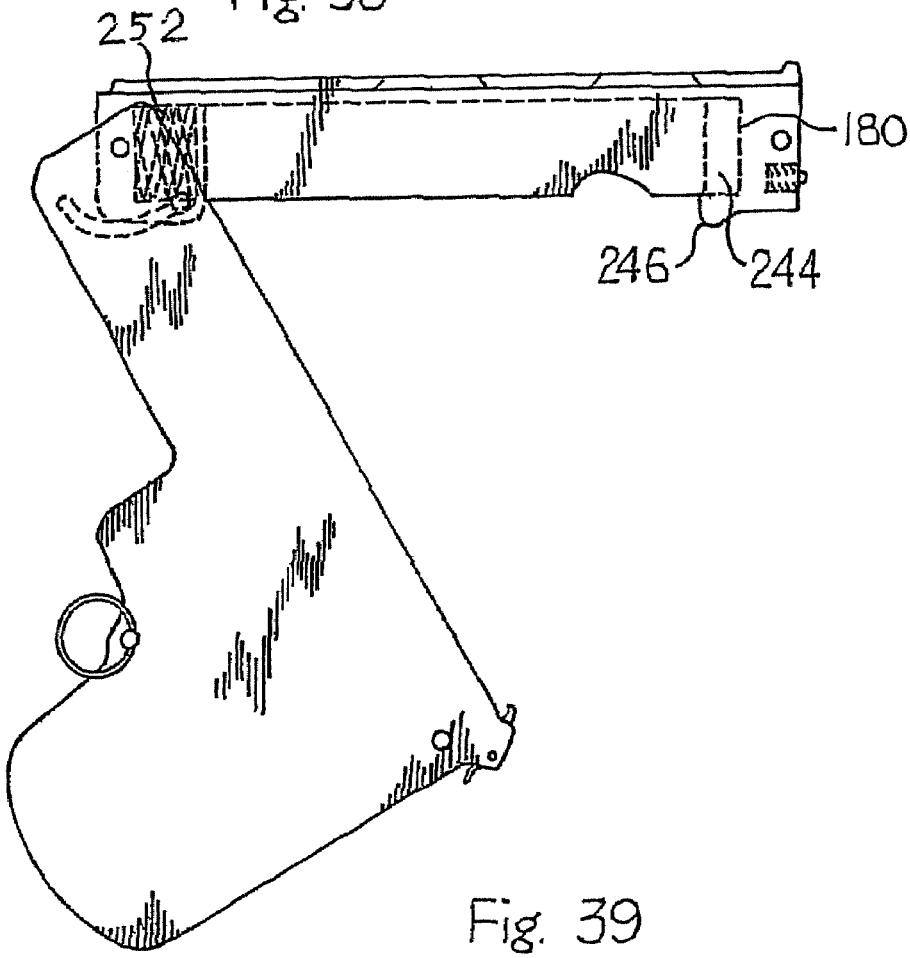
FIG. 39 shows a side elevational view of a mountable holster shroud with a wave spring and a rotatable pistol-encapsulating cover in the open position.

A third embodiment of the present invention is a holster assembly comprised of a rotatable pistol encapsulating holster cover 166, also known as a hood, connected to a mountable holster slide shroud 168 for carrying and storing a pistol in either an unloaded or loaded state. The mountable holster slide shroud 168 is a modified version of the previous embodiments of the holster slide shroud 92. The mountable holster slide shroud 168 includes a barrel muzzle access port 170, a bottom of slide stop bearing platform 172, a detent for a locking safety lever 178, and a holding member. The holding member is either an action locking lug 174 provided within the mountable holster shroud or, alternatively, a slide-capturing element 246. Where a slide-capturing element 246 is provided, a rear of slide encapsulating and bear point space 244 is provided as shown in FIGS. 38 and 39. Alternatively, a wave spring is provided in the muzzle receiving space, thereby replacing the bottom of slide stop bearing platform 172. In the above embodiment, the wave spring acts as the bias activating assembly for housing the pistol in the holster. Also provided in the mountable slide shroud 168 is an imbedded compressible ball bearing unit 196, a locking pin access hole 202 and a raised element 191. In addition, a fixed rotator pin 182, load bearing plates 184 permanently affixed to interior sides of the holster shroud base, and a stainless steel load bearing pin 186 are provided with the mountable holster slide shroud 168.

The rotatable pistol encapsulating holster cover 166 includes a holster cover locking pin access hole 204, a thumb operated slide lock release 190, a receiving indent for the ball bearing of the compressible ball bearing unit, a rapid locking pin storage hole 200 and a rotatable guide slot 188.

The rotatable pistol encapsulating holster cover 166 is attached to the front of the mountable holster slide shroud 168 with the fixed rotator pin 182 and the stainless steel load bearing pin 186. The rotatable pistol encapsulating holster cover 166 rotates about an axis that lies perpendicular to the muzzle of a pistol loaded in the holster system. The fixed rotator pin 182 provides an axis that the rotatable encapsulating holster cover 166 rotates about when moved between the closed position shown in FIG. 30*a* to the open position shown in FIG. 30*b*. In addition, the stainless steel load bearing pin 186 that is housed in the base of the mountable holster slide shroud 168 guides the rotatable guide slot 188 provided in the base of the rotatable pistol encapsulating holster cover 166 while the rotatable encapsulating holster cover 166 is being rotated downward or upward. Load bearing plates 184 affixed to both interior sides of the holster shroud base provide structural support while rotating the rotatable pistol encapsulating holster cover 166.

Figure 30A:
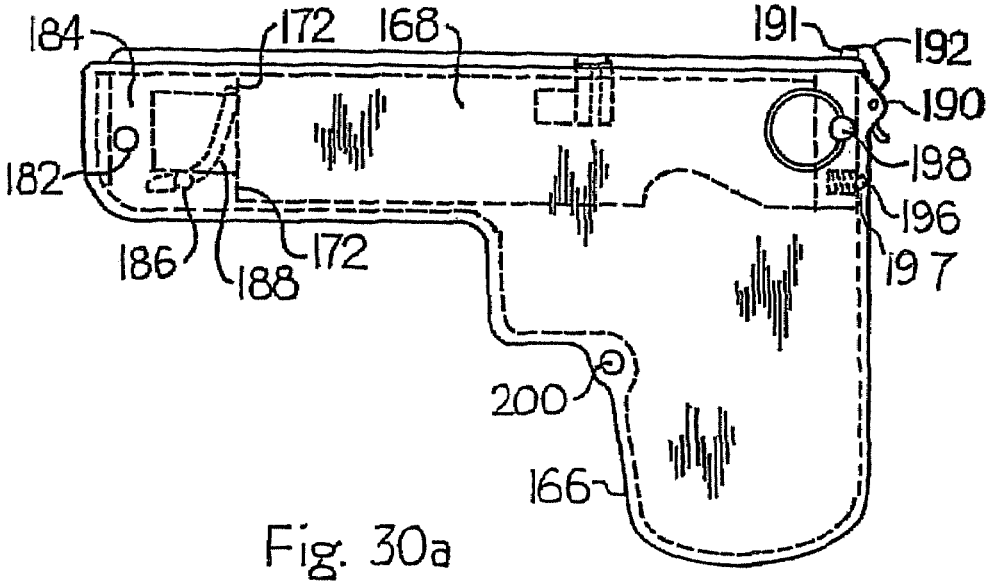
FIG. 30*a* shows a side elevational view of a mountable holster shroud with a slide block and a rotatable pistol-encapsulating cover in the closed position.
Figure 30B:
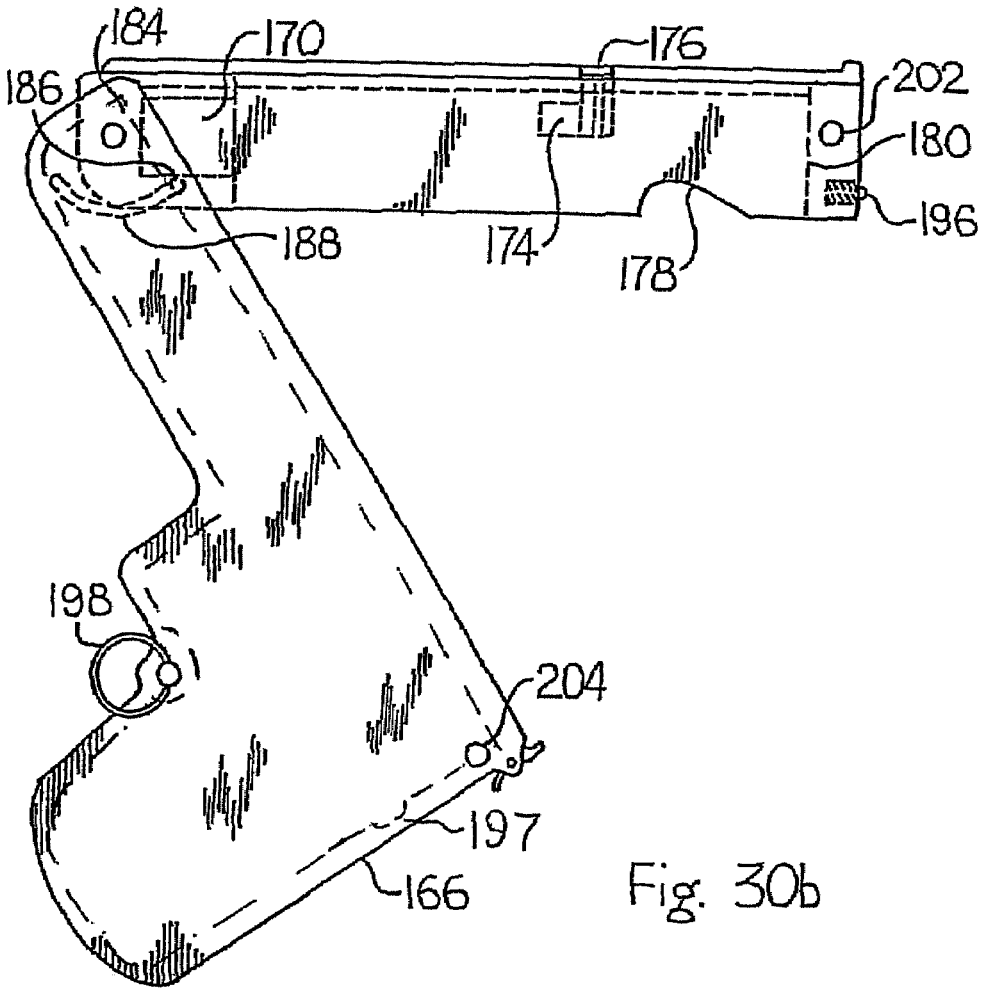
FIG. 30*b* shows a side elevational view of a mountable holster shroud and a rotatable pistol-encapsulating cover in the open position.

In the closed position as shown in FIG. 30*a*, the thumb operated slide lock release 190 locks over the raised element 191 to secure the rotatable pistol encapsulating holster cover 166 in place in the closed position. Additionally, the ball bearing of the compressible ball bearing unit 196 is received in a receiving indent 197. A rapid release ball bearing locking pin 198 is inserted through the holster cover locking pin access holes 204 of the rotatable pistol encapsulating holster cover 166 and the locking pin access hole 202 of the mountable holster slide shroud 168. In the closed position, the rotatable pistol encapsulating holster cover 166 is perfectly aligned with the internal and external surfaces of the mountable holster slide shroud 168 thereby creating a frictional closure of the two parts so that the holster cover locking pin access hole 204 of the mountable holster slide shroud 168 is perfectly aligned with the locking pin access hole 204 of the mountable holster shroud. 128) The closed holster system is opened by first removing the rapid release ball bearing locking pin 198 from the holster cover locking pin access holes 204 of the rotatable pistol encapsulating holster cover and the locking pin access hole 202. The rapid release ball bearing locking pin 198 can be placed ill the locking pin storage hole 200. The thumb operated slide lock release 190 is pressed forward thereby releasing the slide lock 192 from the raised element 191. Force is exerted in a downward and rearward direction to rotate the rotatable pistol encapsulating holster cover 166 away from the mountable holster slide shroud 168. The force must initially overcome the ball bearing of the compressible ball bearing unit 196 that is in the receiving indent 197 for the ball bearing. Additionally, the space provided during the downward rotation of the rotatable pistol encapsulating holster cover 166 about the axis of the fixed rotator pin 182 allows the rotatable pistol encapsulating holster cover 166 to pass over the top of mountable holster shroud 168 and the depressible ball bearing 194 resting the receiving area for the ball bearing.

During the rotation of the rotatable pistol encapsulating holster cover 166 between the open position and the closed position or vice versa, the rotation guide slot 188 guides the rotatable pistol encapsulating holster cover 166 in a prescribed arc in relation to the stainless steel load bearing pin 186. The load bearing plates 184 permanently affixed to the both interior side of the holster shroud base provide structural support to the holster assembly as does the barrel muzzle access port 170, which houses the fixed rotator pin 182 and the stainless steel loading bearing pin 186. Additionally, the bottom of the slide bearing platform 172 and the rotatable guide slot 188 for the load bearing pin 186 function to transmit the load pressure from the fixed rotator pin 182 so that the fixed rotator pin 182 is not under load pressure when the rotatable pistol encapsulating holster cover 166 is in the open position. The increased strength of the combination of the load bearing plates 184 permanently affixed to the both interior side of the holster shroud base, the fixed rotator pin 182, and the barrel muzzle access port 170 prevents the rearward action of rotatable pistol encapsulating holster cover 166 from causing damage to the fixed rotator pin 182.

Figure 31:
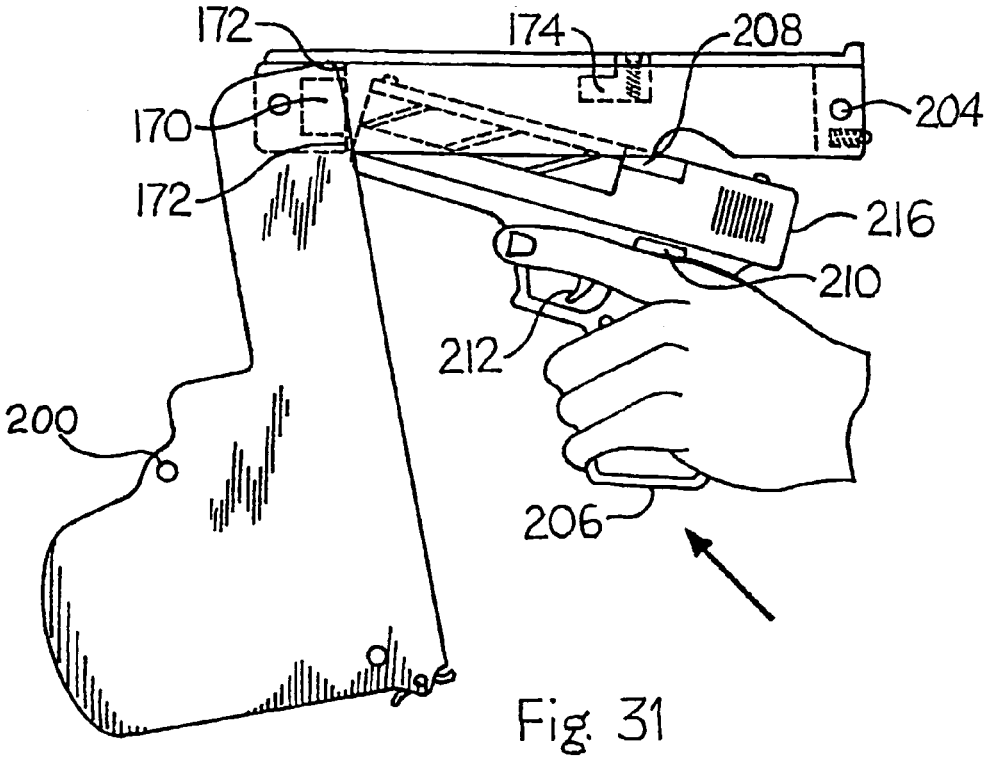
FIG. 31 shows a side elevational view of a pistol being inserted in the mountable holster shroud.

FIG. 31 shows a semi-automatic pistol is being inserted into the mountable holster shroud 168 having an action locking lug 174 mounted to the top surface of the mountable holster slide shroud 168, with the rotatable pistol encapsulating holster 166 in the open position. The muzzle end of the pistol is placed against the slide stop-bearing platform 172. A magazine is not loaded within the pistol grip 206 and the battery of the pistol must been cleared before placing the pistol against bottom of the slide stop bearing platform 172. The chamber of the pistol is closed 208, and the safety lever of the pistol 210 is disengaged. However, the trigger 212 is operational because the slide is closed. The pistol is inserted into the mountable holster slide shroud 168 with a downward force as indicated by the white arrow.

Figure 32:
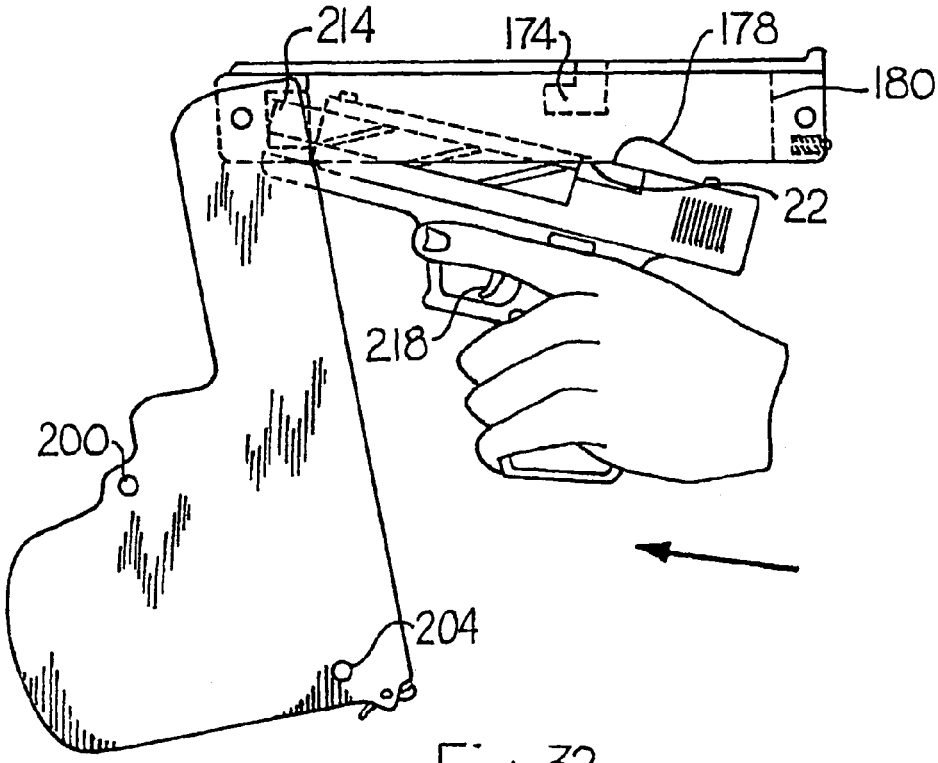
FIG. 32 shows a side elevational view of a pistol further inserted into the mountable holster shroud.

FIG. 32 shows a downward force being applied on the pistol grip as the muzzle portion of the slide 214 bears on the slide stop bearing platform 172, which restrains the slide from continuing downward. At this point, the grip, frame and barrel continue in the downward motion as the muzzle end of the slide is held against the slide stop bearing platform 172 with the recoil spring compressing inside the frame of the pistol. In the above embodiment, the recoil spring acts as the bias activating assembly for housing the pistol in the holster. This movement of the slide is the standard operating procedure of the slide to frame action in loading and/or unloading or firing and/or ejecting. As the pistol grip is forced to its most forward position, the muzzle end of the barrel 220 passes through the barrel muzzle access port 170 thereby rendering the chamber empty and open 222. The open empty chamber 222 provides a significant safety feature because all semi-automatic pistols will only fire if the slide is locked in a closed position relative to the frame with a round chambered.

Figure 33:
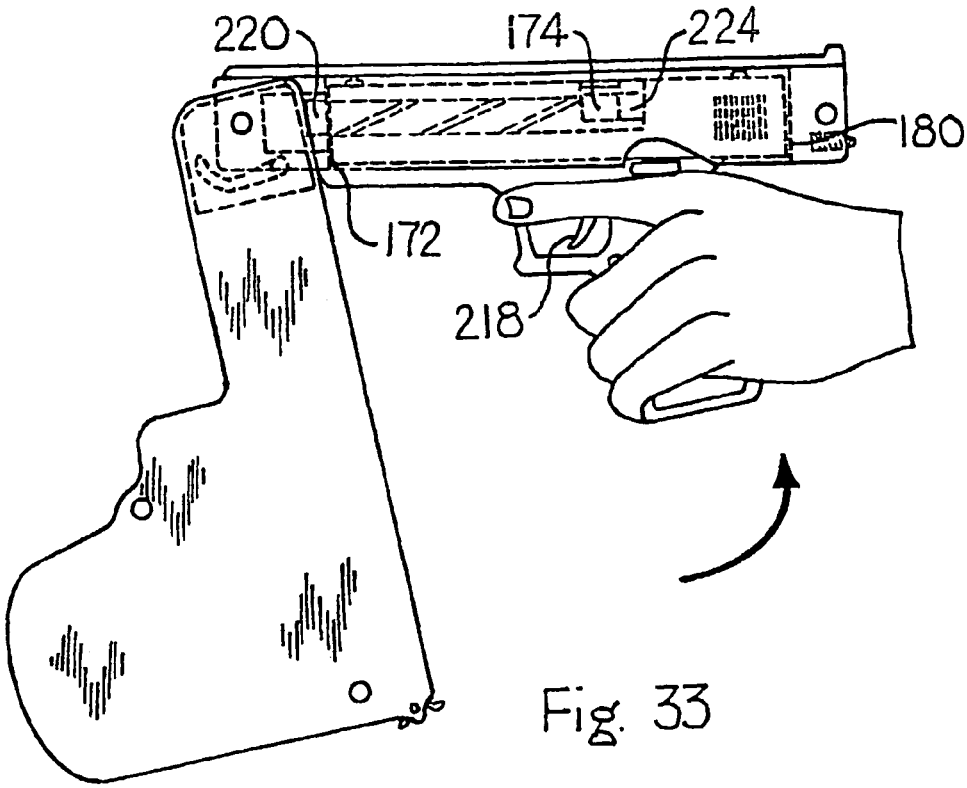
FIG. 33 shows a side elevational view of a pistol firmly held in the mountable holster shroud.

FIG. 33 shows the forward rotation of the pistol so the top of the slide presses against the interior surface of the top of the slide stop 180, thereby positioning the action-locking lug 174 within the open empty chamber 222. A lessening of the downward pressure on the grip of the pistol allows the recoil spring of the pistol to expand, thereby allowing the pistol-frame and grip to move into an upward position. The upward action of the frame allows the action locking lug 174 to enter the open and empty chamber 222 and is stopped by the action locking lug platform 224. The pistol is locked securely within the shroud with the chamber partially open because of the action locking lug platform 224, and the trigger is in a non-operational state 218. Additionally, the presence of the action locking lug 174 depresses the top round of a loaded magazine in the grip so as to prevent any loading of the pistol while the action locking lug 174 and action locking lug platform 224 are within the chamber of the pistol.

Figure 34:
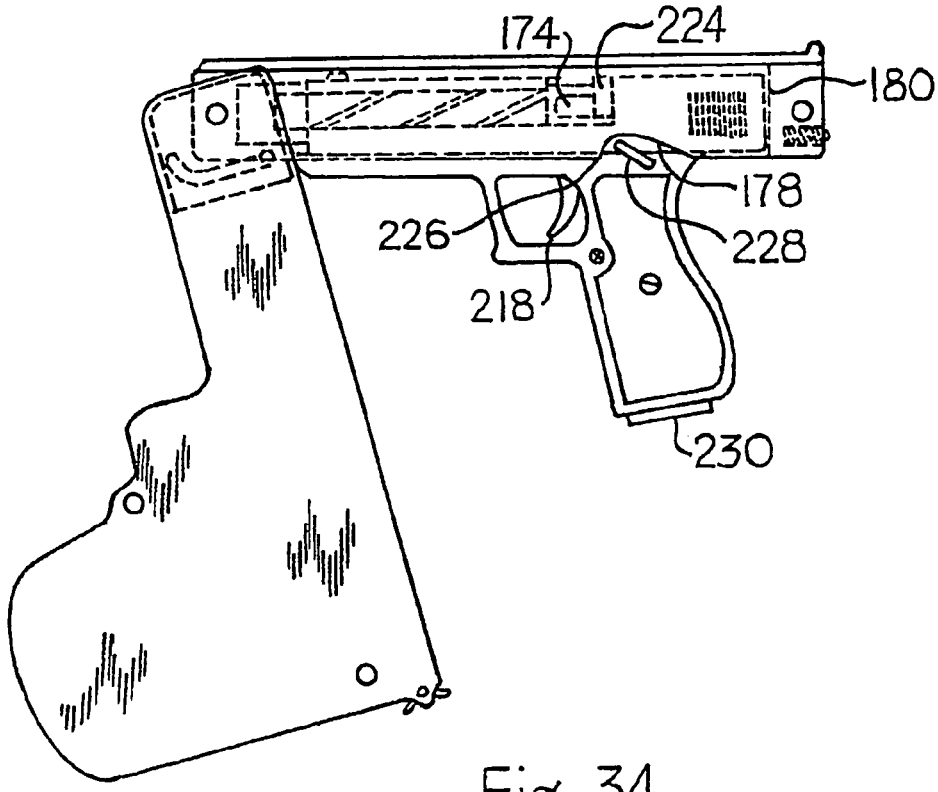
FIG. 34 shows a side elevational view of a pistol firmly held in the mountable holster shroud with the safety lever in the safe position.

As shown in FIG. 34, the pistol is now stowed in the shroud by the force of the expanding recoil spring of the pistol which is exerting an upward pressure but is being blocked to its utmost closure by the action locking lug 174 and the action locking lug platform 224. The pistol's safety lever 226 is moved into the no fire, up position 228 into the holster shroud detent locking surface 178, thereby preventing the pistol from being pushed down. The pistol is now stowed in the mountable holster slide shroud 168 incapable of firing because no ammunition is present in the chamber and the trigger is disengaged. Additionally, the safety lever prevent the downward motion of the pistol, and the top of slide stop 180 and the action locking lug held in place by the recoil spring stops the upward motion of the pistol. The pistol can be stored safely and incapable of being fired in the stowed position with or with a loaded magazine 230.

Figure 35:
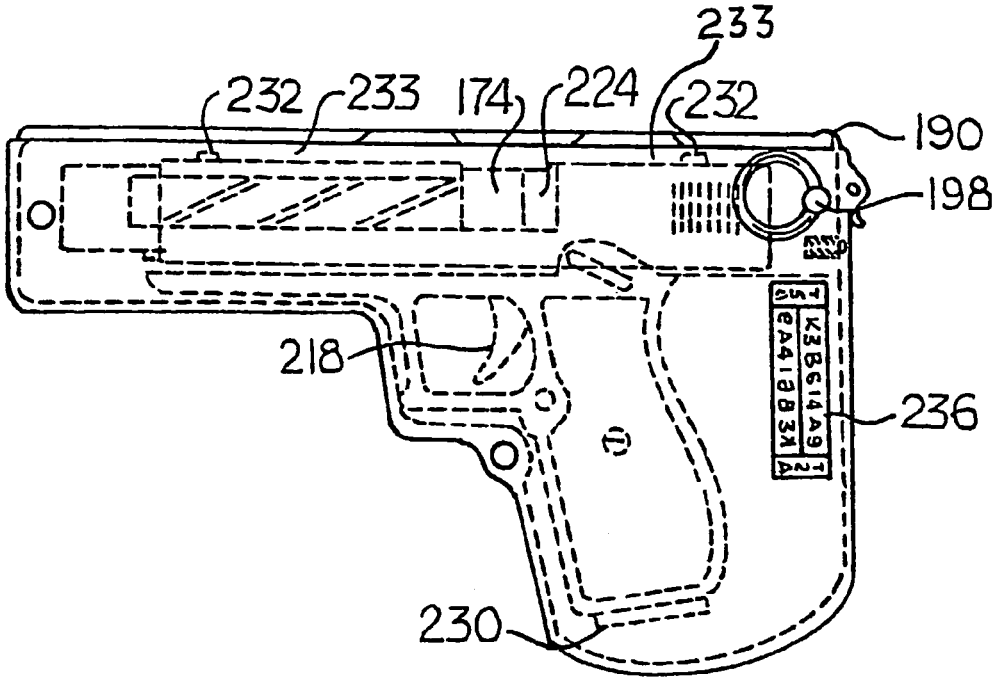
FIG. 35 shows a side elevational view of a pistol firmly held in the mountable holster shroud with the rotatable pistol-encapsulating cover in the closed position having therein an engraved, non-removable lead plate.

FIG. 35 shows a pistol stowed in the mountable holster slide shroud 168 with the rotatable pistol encapsulating holster cover 166 in the closed position. The rotatable pistol encapsulating holster cover 166 is held in place by the ball bearing of the compressible ball bearing assembly, the thumb operated slide lock 190 engaging the raised element 191 of the mountable holster shroud 168, and the rapid release ball bearing locking pin 198 locks the mountable holster slide shroud. 168 and the rotatable pistol encapsulating holster cover 166 together. The pistol's front and rear sights 232 are positioned within internal protective sight grooves 233 in the mountable holster shroud 168. The pistol is not loaded and cartridges cannot be fed from the magazine into the chamber because of the presence of the action-locking lug 174 within the chamber. The trigger is disengaged 218.

FIG. 35 shows an additional embodiment of the present invention that provides an engraved, non-removable lead plate 236 with a double mirrored identification code that can be read by x-ray. By x-ray, the examination of the engraved, non-removable lead plate 236 can confirm the ownership of the pistol and the authorization to carry the stowed pistol in the locked holster assembly regardless of the side that the pistol is resting while being x-rayed. This embodiment is extremely useful to security guards, police, airline pilots and military personnel because they could be issued holsters that are coded to a identification number, which confirms that the holster assembly that corresponds with the identify of the carrier of the pistol and contains a pistol with a known serial number.

Figure 36:
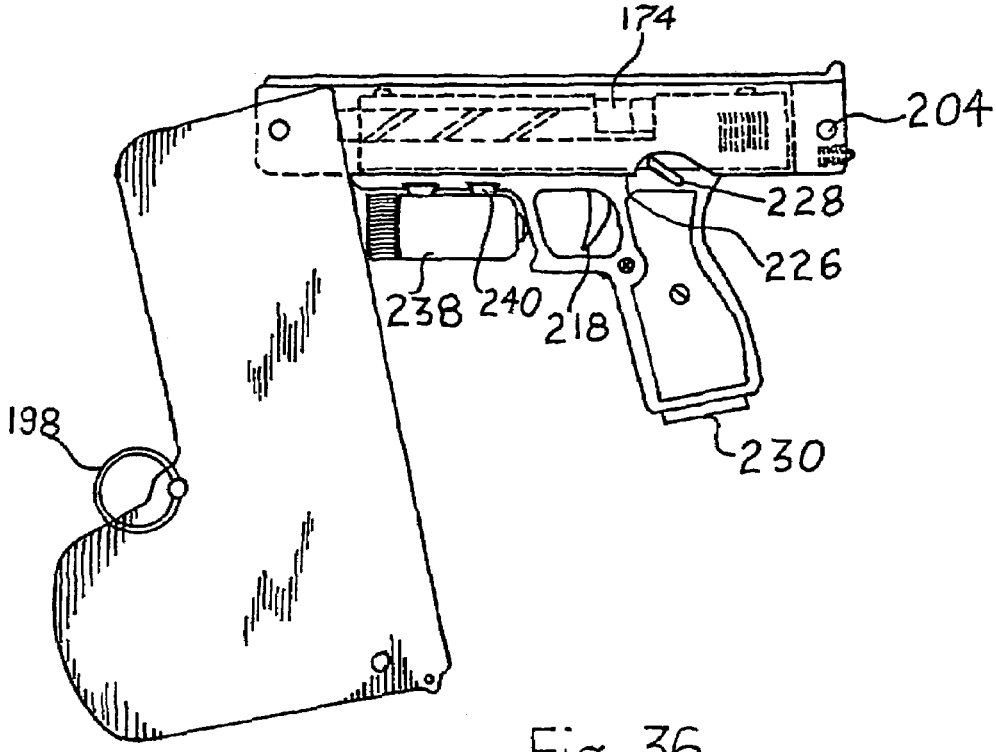
FIG. 36 shows a rotatable pistol-encapsulating cover modified to house an illumination device.
Figure 37:
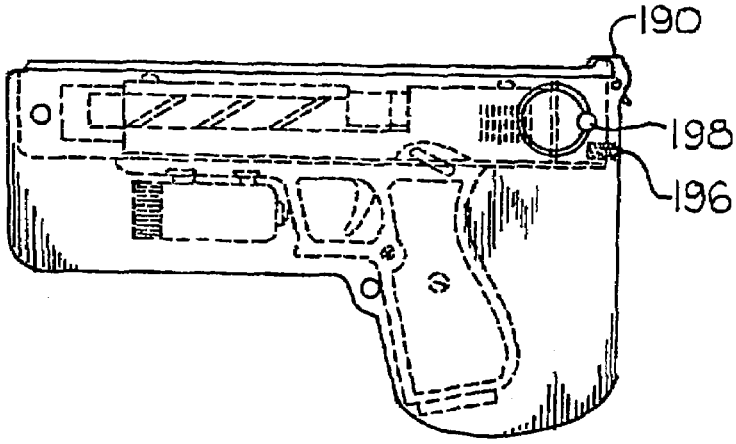
FIG. 37 shows the rotatable pistol encapsulating cover shown in FIG. 36 in the closed position.

FIGS. 36 and 37 show a further embodiment of the invention whereby the rotatable pistol-encapsulating holster cover 166 is adapted to enclose a illumination or laser module 238 affixed to the frame of the pistol by mounts 240. The pistol an illumination and/or laser module 238 is protected from damage, misalignment, and environmental exposure when the rotatable pistol encapsulating holster cover 166 is closed and locked to the mountable holster shroud 168.

FIGS. 38 and 39 show a further embodiment of the invention that provides a rotatable pistol encapsulating cover 166 wherein a pistol can be stored in a holster slide shroud 242 in a loaded condition with an operational trigger. In this embodiment, the holding member is a slide-capturing element 246. A wave spring 252 is provided in the muzzle receiving space, thereby replacing the bottom of slide stop bearing platform 172 and a rear of slide encapsulating and bear point space 244 is provided as shown in FIGS. 38 and 39 to receive the rear slide portion of the slide against the slide stop surface 180.

Figure 40:
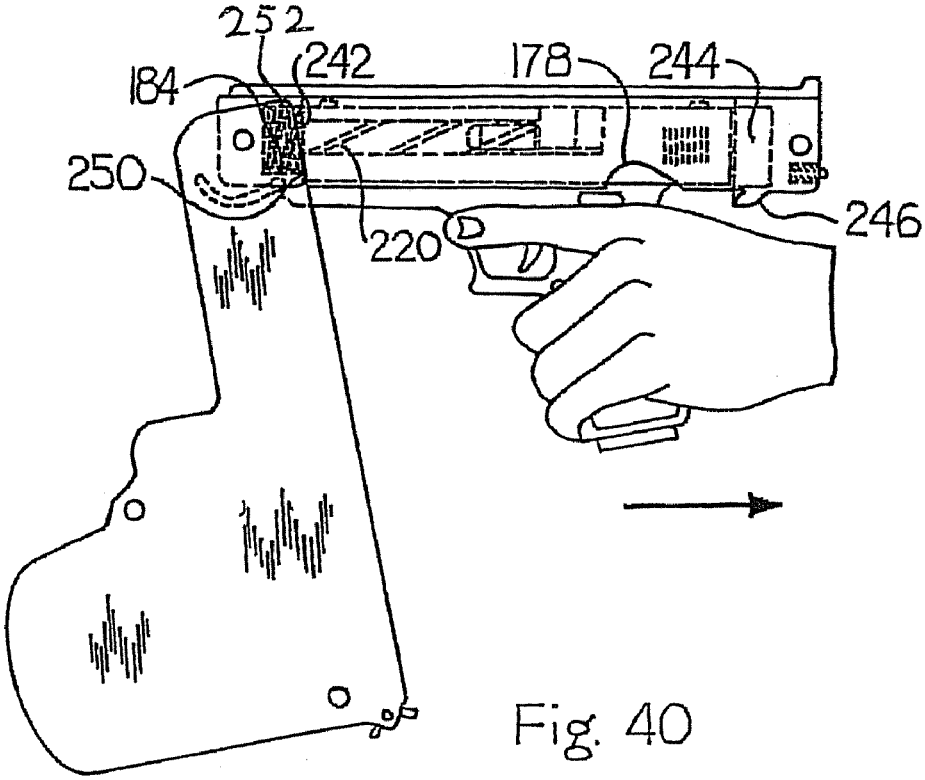
FIG. 40 shows a side elevational view of a pistol being inserted in the mountable holster shroud having a wave spring.
Figure 41:
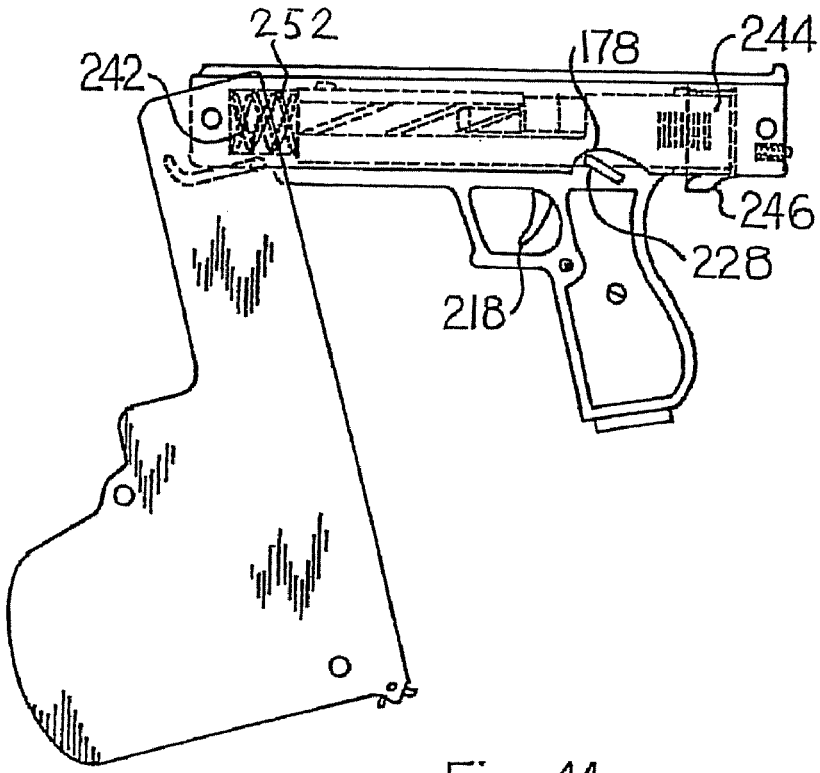
FIG. 41 shows a side elevational view of a pistol firmly held in the mountable holster shroud having a wave spring.

FIGS. 40 and 41 show the insertion of a pistol into mountable holster slide shroud 168. During insertion, the barrel muzzle 220 is placed against the muzzle end bearing surface 250 that is attached to a wave spring 252. A loaded pistol with a round in the battery with the safety lever disengaged 248 and the trigger in an operational state 212 can be inserted and stowed in this embodiment of the holster assembly. FIG. 40 shows that the slide of the pistol, by way of downward force compressing the wave spring to its maximum compression, clears the slide-capturing element 246. As shown in FIG. 41, releasing the forward force on the grip of the pistol allows the wave spring 252 to expand while the muzzle end of the pistol is still bearing on the muzzle end bearing surface 250 attached to the wave spring 252, which pushes the pistol upward into the rear of slide encapsulating and bear point space 244 and against the slide stop surface 180. FIG. 40 shows the pistol stowed in the holster and incapable of withdrawal by upward force. Additionally, the safety lever of the pistol can be engaged 228 and is received in the holster shroud detent locking surface 178 thereby preventing downward force from moving the pistol. Also, the engaged safety lever of the pistol renders a pistol inoperative because the pistol cannot be fired with the safety lever engaged. In FIG. 41, the pistol cannot be withdrawn in an upward action by an assailant, nor can it be pushed down to withdraw it as the engaged pistol safety-lever will bind on the holster's shroud detent locking surface for the pistol's safety lever.

Figure 42:
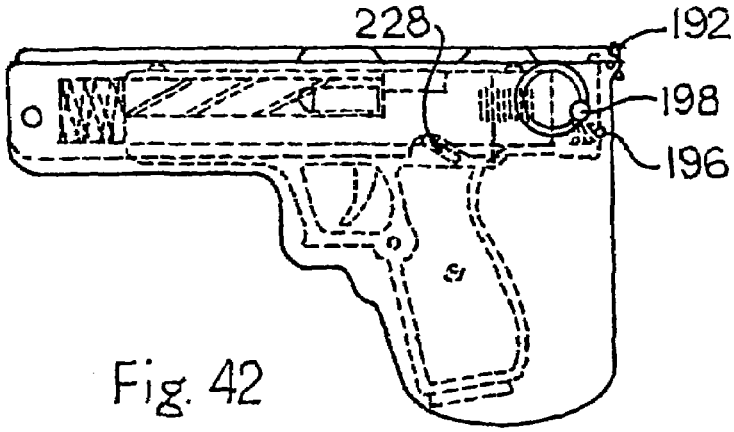
FIG. 42 shows a side elevational view of a pistol firmly held in the mountable holster shroud having a wave spring with the rotatable pistol encapsulating cover in the closed position.

FIG. 42 shows the stowed pistol in this embodiment of the holster configuration with the rotatable pistol encapsulating holster cover 166 in the closed position with the safety engaged, the rapid release ball bearing locking pin 198 engaged, the thumb operated slide lock 192 automatically locked, and the ball bearing of the ball bearing enclosure 196 bearing on the receiving area, thereby totally locking the pistol and holster in the closed position.

Figure 43:
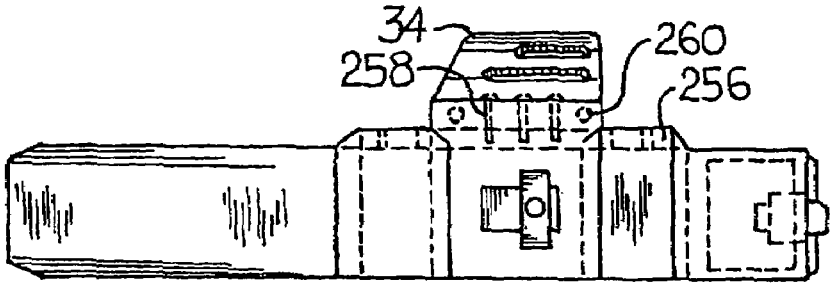
FIG. 43 shows a top elevational view of a mountable holster shroud having a shroud hip plate assembly attached to a shroud hip plate assembly mounting plate.

Several secondary features of the invention are applicable to either alternative embodiment of the third preferred embodiment. As shown in FIG. 43, a hip mount platform 256 is provided in the top of the mountable holster slide shroud 168 to which a hip mount assembly 34 can be secured as shown in FIG. 43. The hip mount platform 256 as shown in FIG. 43 has adjustable screw holes 258 to receive screws 258 to mount the hip mount assembly 34 to the hip mount platform 256. The hip mount assembly includes ancillary locking pin storage holes 260.

Figure 44:
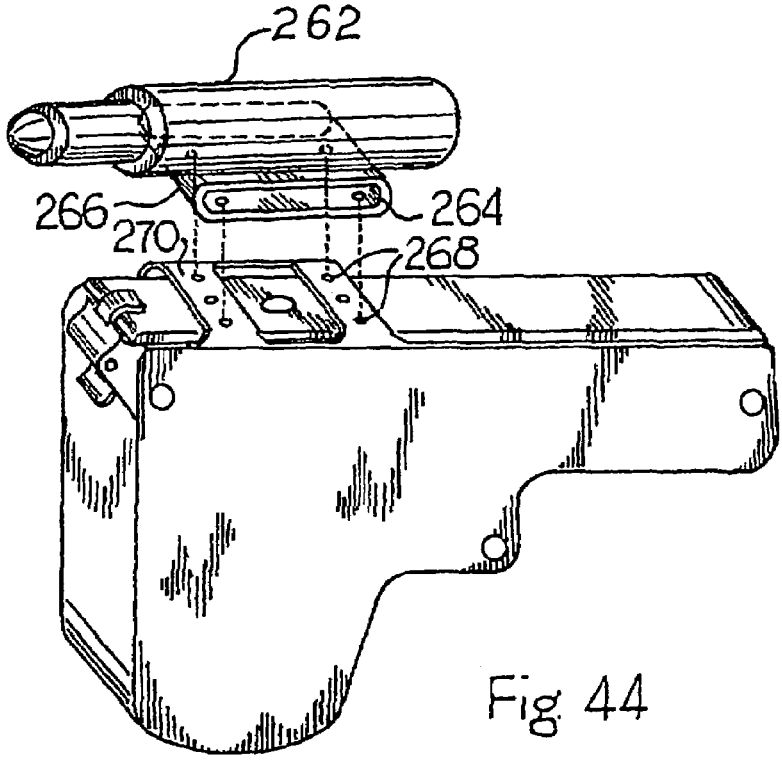
FIG. 44 shows a side perspective view of the holster assembly fitted to house an expandable baton.

FIG. 44 shows a holster assembly in a closed position with a secondary storage mount 270 to mount on an expandable baton carrier 262 with mounting screws that can be inserted through the mounting holes 264 of an expandable baton carrier base plate 266 to receiving holes 268 on a secondary storage mount 270 on the holster assembly.

Figure 45:
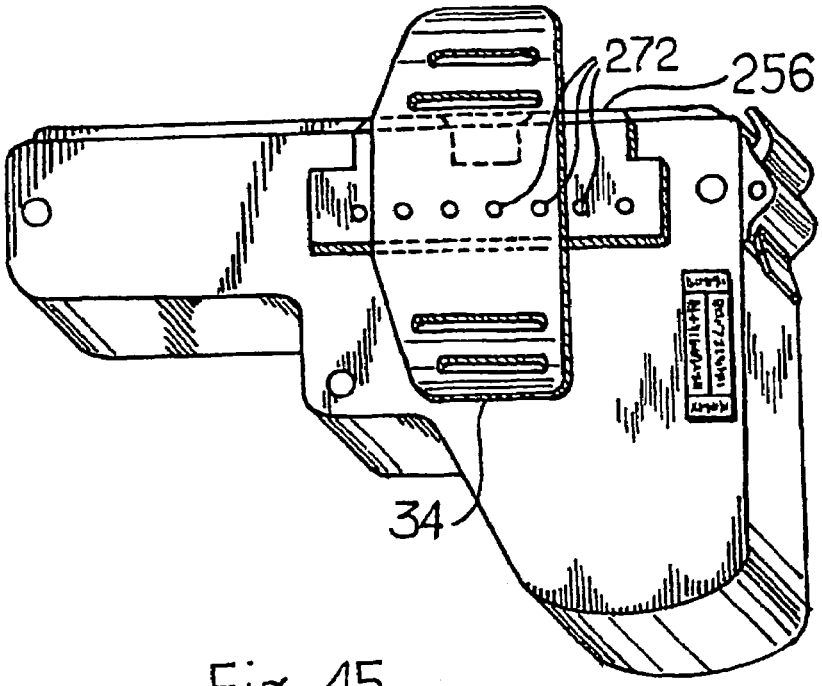
FIG. 45 shows a side perspective view of a mountable holster shroud having a shroud hip plate assembly attached to a shroud hip plate assembly mounting plate.

FIG. 45 shows a hip mount assembly 34 is secured to the hip mount platform 256 with screws 272 as shown in FIG. 22.

Figure 46:
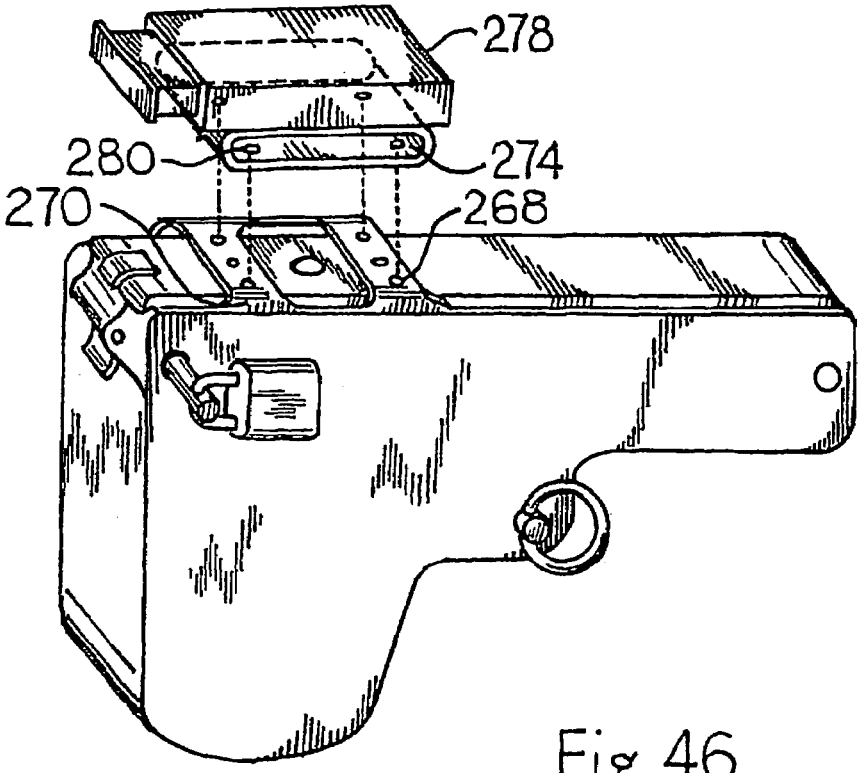
FIG. 46 shows a side perspective view of a holster assembly fitted to house a spare magazine holder.

FIG. 46 shows a spare magazine mounting plate 274 secured to the spare magazine carrier base 276 of a spare magazine carrier 278. The spare magazine carrier base 274 dove tails into a secondary storage mount 270 on the holster assembly and is held in place with height adjustable screws that pass through mounting holes 280 of the spare magazine mounting plate 274 and are secured in receiving holes 268 in the secondary storage mount 270.

Although specific embodiments of the invention have been described in detail in this application, it will be appreciated by those skilled in the art that various modifications and alternatives to those details could be developed in light of the overall teachings of the disclosure. The present preferred embodiments described herein are meant to be illustrative only and not limiting as to the scope of the invention which is to be given the full breadth of the appended claims and any and all equivalents thereof.

The invention claimed is:

1. A holster for stowing a portable handheld firearm the holster comprising:

a shroud at least partially receiving the firearm therein, the shroud having a front end and a back end, the shroud defining a muzzle receiving space at the front end thereof and a firearm holding member spaced from the muzzle receiving space;

a bias activating assembly mounted in the front end of the shroud for biasing the firearm into a stowed position against the holding member; and a hood enclosure moveable between an open position that allows for insertion and withdrawal of the firearm from the shroud, and a closed position which substantially encapsulates the firearm within the shroud when the firearm is in the stowed position, the hood enclosure pivotable about an axis substantially perpendicular to an axis of the muzzle of the firearm with the firearm in the stowed position, wherein the hood enclosure pivots about a point in the front end of the shroud, wherein the shroud includes a spring biased detent receivable in a detent recess in the hood enclosure when the hood enclosure is in the closed position.

2. A holster for stowing a portable handheld firearm the holster comprising:

a shroud at least partially receiving the firearm therein, the shroud having a front end and a back end, the shroud defining a muzzle receiving space at the front end thereof and a firearm holding member spaced from the muzzle receiving space;

a bias activating assembly mounted in the front end of the shroud for biasing the firearm into a stowed position against the holding member; and a hood enclosure moveable between an open position that allows for insertion and withdrawal of the firearm from the shroud, and a closed position which substantially encapsulates the firearm within the shroud when the firearm is in the stowed position, the hood enclosure pivotable about an axis substantially perpendicular to an axis of the muzzle of the firearm with the firearm in the stowed position, wherein the hood enclosure pivots about a point in the front end of the shroud, wherein the hood enclosure includes a thumb actuated slide lock that is engageable with the shroud when the hood enclosure is in the closed position.

3. A holster for stowing a portable handheld firearm the holster comprising:

a shroud at least partially receiving the firearm therein, the shroud having a front end and a back end, the shroud defining a muzzle receiving space at the front end thereof and a firearm holding member spaced from the muzzle receiving space;

a bias activating assembly mounted in the front end of the shroud for biasing the firearm into a stowed position against the holding member; and a hood enclosure moveable between an open position that allows for insertion and withdrawal of the firearm from the shroud, and a closed position which substantially encapsulates the firearm within the shroud when the firearm is in the stowed position, the hood enclosure pivotable about an axis substantially perpendicular to an axis of the muzzle of the firearm with the firearm in the stowed position, wherein the hood enclosure pivots about a point in the front end of the shroud, wherein the hood enclosure includes a locking pin that is received through aligned holes in the hood enclosure and the shroud when the hood enclosure is in the closed position for locking the hood enclosure in the closed position, and the hood enclosure includes a pair of holes for holding the locking pin in an inoperative position.

4. A holster for stowing a portable handheld firearm the holster comprising:

a shroud at least partially receiving the firearm therein, the shroud having a front end and a back end, the shroud defining a muzzle receiving space at the front end thereof and a firearm holding member spaced from the muzzle receiving space;

a bias activating assembly mounted in the front end of the shroud for biasing the firearm into a stowed position against the holding member; and a hood enclosure moveable between an open position that allows for insertion and withdrawal of the firearm from the shroud, and a closed position which substantially encapsulates the firearm within the shroud when the firearm is in the stowed position, the hood enclosure pivotable about an axis substantially perpendicular to an axis of the muzzle of the firearm with the firearm in the stowed position, wherein the hood enclosure pivots about a point in the front end of the shroud, wherein the hood enclosure includes a pair of guide slots and the shroud includes a pivot pin defining the pivot axis of the hood enclosure and a guide pin, wherein the guide pin of the shroud is received in the guide slots for guiding the movement of the hood enclosure.

5. A holster for stowing a portable handheld firearm the holster comprising:

a shroud at least partially receiving the firearm therein, the shroud having a front end and a back end, the shroud defining a muzzle receiving space at the front end thereof and a firearm holding member spaced from the muzzle receiving space;

a bias activating assembly mounted in the front end of the shroud for biasing the firearm into a stowed position against the holding member; and a hood enclosure moveable between an open position that allows for insertion and withdrawal of the firearm from the shroud, and a closed position which substantially encapsulates the firearm within the shroud when the firearm is in the stowed position, the hood enclosure pivotable about an axis substantially perpendicular to an axis of the muzzle of the firearm with the firearm in the stowed position, wherein the hood enclosure pivots about a point in the front end of the shroud, wherein the shroud further includes an L-shaped slot on at least one side thereof, wherein the L-shaped slot receives a projection extending from the side of the firearm.

6. A holster for stowing a portable handheld firearm, the holster comprising:

a shroud at least partially receiving the firearm therein, the shroud defining a muzzle receiving space at a front end thereof and an action locking lug mounted to the shroud and received through an ejection port of the firearm with the firearm in the stowed position;

the shroud further comprising a back end located opposite the front end, a first side wall extending from the front end to the back end, a second side wall extending from the front end to the back end, a top wall extending from the front end to the back end, and an opening for inserting the firearm into the shroud disposed opposite the top wall and extending at least partially between the front end and the back end;

a slide engaging platform in the front end of the shroud preventing forward movement of a slide of the firearm past the slide engaging platform, whereby a frame and barrel of the firearm move relative to the slide during insertion and withdrawal of the firearm into and out of the shroud, whereby a recoil spring of the firearm biases the barrel of the firearm against the action locking lug when the firearm is in the stowed position; and an L-shaped slot on at least one side wall of the shroud, wherein the L-shaped slot receives a projection extending from the side of the firearm.

7. The holster of claim 6, wherein each L-shaped slot receives a projection from a handle portion of the firearm.

8. The holster of claim 6, wherein each L-shaped slot receives a take down button of the firearm.

9. The holster of claim 6, wherein each L-shaped slot receives a safety lever of the firearm.

10. The holster of claim 6, further including a hood enclosure moveable between an open position that allows for insertion and withdrawal of the firearm from the shroud, and a closed position which substantially encapsulates the firearm within the shroud when the firearm is in the stowed position, the hood enclosure pivotable about an axis substantially perpendicular to an axis of the muzzle of the firearm with the firearm in the stowed position, wherein the hood enclosure pivots about a point in the front end of the shroud.

* * * * *

UNITED STATES PATENT AND TRADEMARK OFFICE

CERTIFICATE OF CORRECTION

PATENT NO. : 7,591,402 B2
APPLICATION NO. : 10/503057
DATED : September 22, 2009
INVENTOR(S) : John N. Rassias It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1271 days.

Signed and Sealed this

Twenty-first Day of September, 2010

David J. Kappos

David J. Kappos
*Director of the United States Patent and Trademark Office*